US006617536B2

(12) United States Patent
Kawaguchi

(10) Patent No.: US 6,617,536 B2
(45) Date of Patent: Sep. 9, 2003

(54) DOME SWITCH

(75) Inventor: Kenichiro Kawaguchi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/994,811

(22) Filed: Nov. 28, 2001

(65) Prior Publication Data

US 2002/0079210 A1 Jun. 27, 2002

(30) Foreign Application Priority Data

Nov. 29, 2000 (JP) ..... P2000-362855
Nov. 29, 2000 (JP) ..... P2000-362939

(51) Int. Cl.[7] ..... H01H 13/70
(52) U.S. Cl. ..... 200/516; 200/512; 200/513
(58) Field of Search ..... 200/406, 512–516, 200/5 A

(56) References Cited

U.S. PATENT DOCUMENTS 4,485,279 A * 11/1984 Nakamura ..... 200/5 A
4,916,262 A * 4/1990 Jungels-Butler et al. .... 200/5 A
5,401,922 A * 3/1995 Asta ..... 200/5 A
5,901,834 A * 5/1999 Inubushi et al. ..... 200/314

* cited by examiner

*Primary Examiner*—Michael Friedhofer
(74) *Attorney, Agent, or Firm*—Sughrue Mion, PLLC

(57) ABSTRACT

A dome switch includes a front sheet (22) which protrudes outside and can be reversed inside and has dome-shaped protuberances (27), each protuberance having an electrode provided therein; an FPC (24) serving as a circuit member having contact points (32), the electrodes of the protuberances being brought into contact when the protuberances (27) are reversed; and a spacer sheet (23) for preventing occurrence of deformation of the front sheet (22) which is to be interposed between the front sheet (22) and the FPC (24) and has through holes (29) formed therein for ensuring contact between the electrodes and the contact points (32). The spacer sheet (23) is caused to act also as a member for ensuring a stroke dimension of the protuberance (27).

13 Claims, 15 Drawing Sheets

FIG. 6
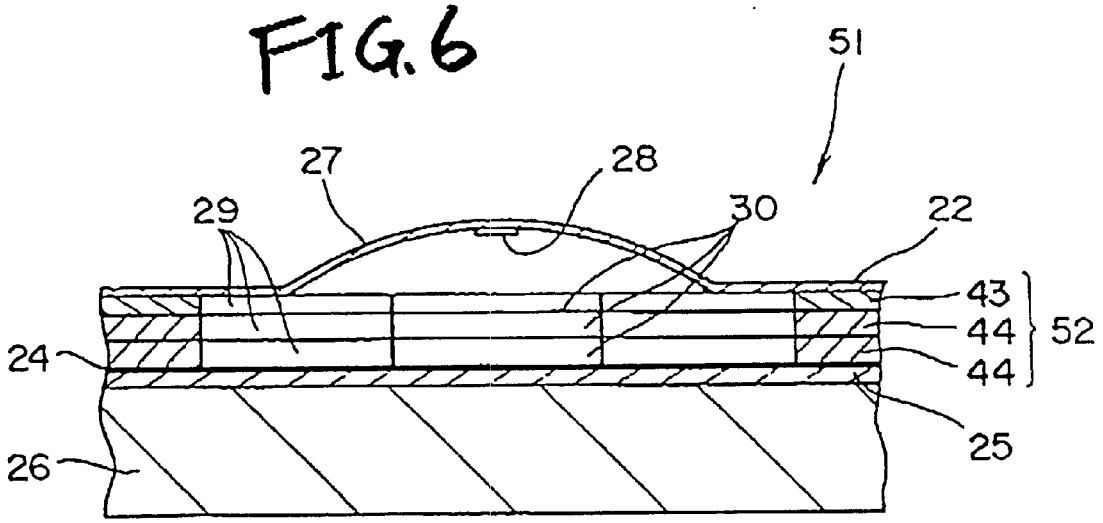
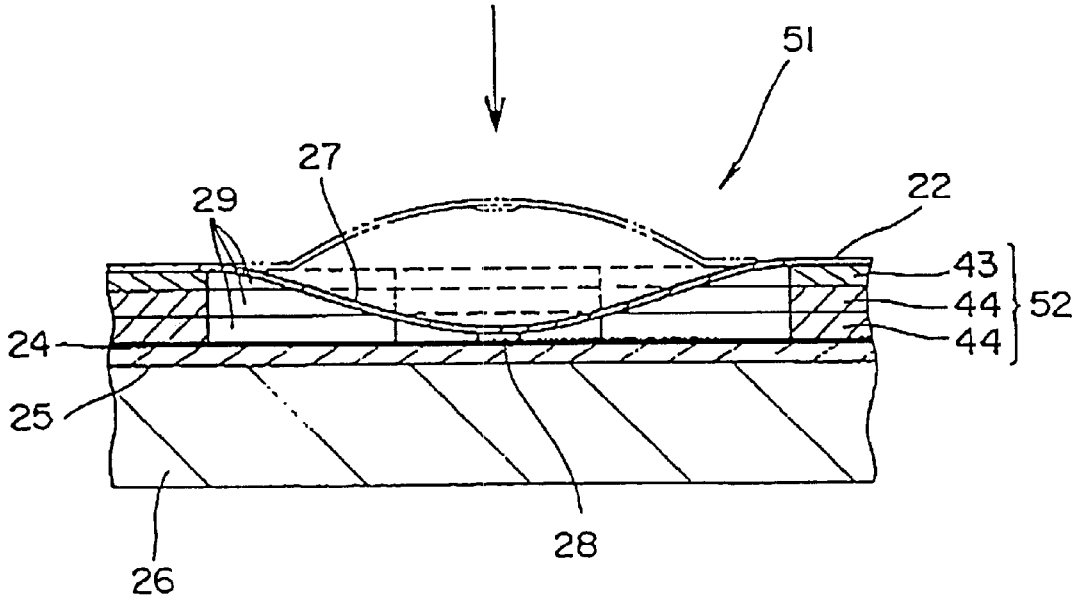
FIG. 7

FIG.16
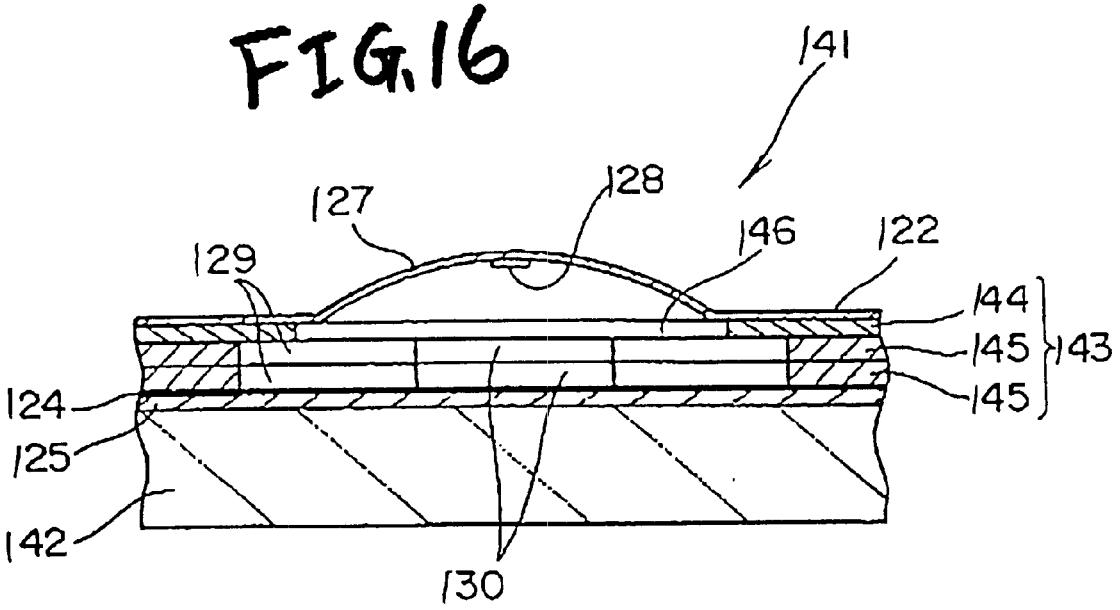
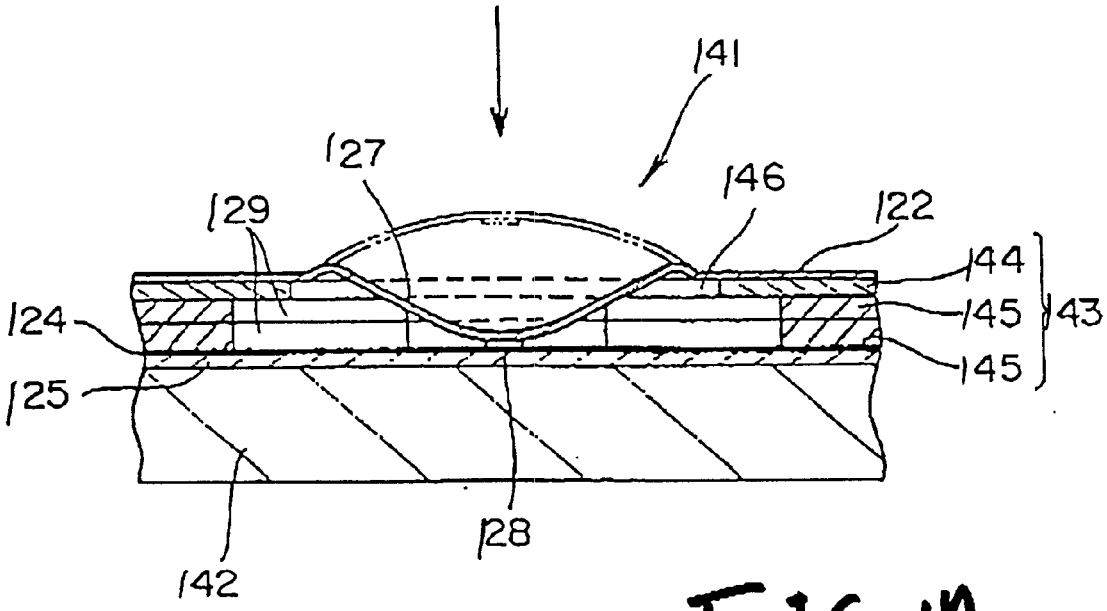
FIG.17

DOME SWITCH

BACKGROUND OF THE INVENTION

The present invention relates to a dome switch provided with a front sheet having dome-shaped protuberances, a spacer sheet and a circuit body, and more particularly, to a dome switch having a distinctive spacer sheet.

FIG. 19 is an exploded perspective view showing a related-art poly-dome switch (dome switch); FIG. 20 is a cross-sectional view showing the principal part of the dome switch before the switch is actuated; and FIG. 21 is a cross-sectional view showing the principal part of the dome switch when the switch is actuated.

A related-art poly-dome switch (dome switch) 1 used in a household electrical appliance is constituted by a front sheet 2, a spacer sheet 3, a flexible printed circuit (FPC) 4 and an adhesive sheet 5. The dome switch 1 is fixed through the adhesive sheet 5 to a plate 6 serving as a mount member.

A plurality of dome-shaped protuberances 7 which can be inverted inward are formed on the front sheet 2 so as to protrude outside. An electrode 8 (see FIG. 13) for the FPC 4 is provided on the interior surface of each protuberance 7.

The spacer sheet 3 is a thin sheet material and is provided for preventing occurrence of deformation of the front sheet 2. An adhesive layer is provided on the front and back of the spacer sheet 3 and enables fixation of the front sheet 2 and the FPC 4. A plurality of through holes 9 are formed at positions on the spacer 3 corresponding to the protuberances 7. Slit-like air release sections 10 are formed between the through holes 9.

The FPC 4 is a circuit member having a plurality of circuits to be designed into a desired pattern. A plurality of contact points 11 with which the electrodes 8 are to be brought into contact are provided on the spacer sheet 3. The FPC 4 is fixed to the adhesive sheet 5 by use of an adhesive. The adhesive sheet 5 has the function as a reinforcement member.

As shown in FIG. 21, according to the construction of the above-mentioned poly-dome switch 1, when any one of the protuberances 7 is depressed, the thus-depressed protuberance 7 becomes inverted toward the FPC 4. As a result, the electrode 8 is brought into contact with the contact point 11, thereby bringing the circuit into conduction. Since the poly-dome switch 1 is used in a household electrical appliance, and a user actuates the switch while viewing the same, ensuring a small stroke dimension (or a short stroke) for the protuberance 7 at the time of actuation of the switch has been sufficient.

The following problems are encountered in utilizing the related-art poly-dome switch 1 as a switch for equipment mounted on a vehicle; e.g., an automobile.

Since switching operation is frequently performed during a driving operation, actuating a switch with visual observation of the same in the manner as mentioned previously is not allowed, because of safety concerns. Accordingly, the poly-dome switch must be structured such that a sufficient stroke dimension of the protuberance 7 is ensured so as to enable a user to ascertain actuation of the switch without visual observation. However, structural limitations are imposed on ensuring a stroke dimension by increasing the protruding height of the protuberance 7.

SUMMARY OF THE INVENTION

The present invention has been conceived against the foregoing backdrop and aims at providing a dome switch which enables an increase in the stroke of a protuberance.

In order to solve the aforesaid object, the invention is characterized by having the following arrangement.

(1) A dome switch including:

a front sheet;

a dome-shaped protuberance which is formed on the front sheet, so as to protrude outside, can be reversed inside and includes an electrode provided therein;

a circuit member having a contact point with which the electrode are brought into contact when the protuberance is reversed; and a spacer sheet for preventing occurrence of deformation of the front sheet, which is interposed between the front sheet and the circuit member, includes a through hole formed therein for ensuring contact between the electrode and the contact point and ensuring a stroke dimension of the protuberance.

(2) The dome switch according to (1), wherein the spacer sheet is constituted by a plurality of layers.

(3) The dome switch according to (1), wherein the spacer sheet is constituted by an uppermost layer spacer sheet and at least one lower layer spacer sheet, and the uppermost layer spacer sheet facing the front sheet is used for finely adjusting the stroke dimension and is formed thinner than the at least one lower layer spacer sheet.

(4) The dome switch according to (1), wherein a plurality of the protuberances are formed on the front sheet, and a plurality of the through holes corresponding to the plurality of the protuberances are formed on the spacer sheet.

(5) The dome switch according to (4), wherein the plurality of the through holes are communicated each other through at least one air release section formed through the spacer sheet.

(6) The dome switch according to (5), wherein the spacer sheet is constituted by an uppermost layer spacer sheet and at least one lower layer spacer sheet, the at least one air release section are formed in the at least one lower layer spacer sheet other than the uppermost layer spacer sheet facing the front sheet.

(7) The dome switch according to (1), wherein the spacer sheet is constituted by an uppermost layer spacer sheet and at least one lower layer spacer sheet, and the through hole formed in the uppermost layer spacer sheet facing the front sheet are formed so as to become greater in diameter than the protuberance, and the through hole formed in the at least one lower layer spacer sheet is formed so as to become greater in diameter than the through hole formed through the uppermost spacer sheet.

(8) A dome switch comprising:

a front sheet;

a dome-shaped protuberance which is formed on the front sheet so as to protrude outside, can be reversed inside, and includes an electrode provided therein;

a circuit member having a contact point with which the electrode are brought into contact when the protuberance is reversed;

a spacer sheet which is interposed between the front sheet and the circuit member and includes a through hole formed therein for ensuring contact between the electrode and the contact point;

an adhesive sheet including at one side thereof a circuit member attachment surface to be adhered to the circuit member and at the other side an adhesive fixing surface to be attached to a mount member including a space section formed in a mount surface thereof; and a air release hole, formed through the adhesive sheet, which communicates the space section with the through hole for air release at the time of reversal of the protuberance when the adhesive sheet adheres the circuit member to the mount member.

(9) The dome switch according to (8), wherein a plurality of the protuberances are formed on the front sheet, and a plurality of the through holes corresponding to the plurality of the protuberances are formed on the spacer sheet.

(10) The dome switch according to (9), wherein the plurality of the through holes are communicated each other through at least one air release section formed through the spacer sheet.

(11) The dome switch according to (10), where in the air release hole is communicated with the at least one air release section.

(12) A dome switch comprising:

a front sheet;

a plurality of dome-shaped protuberances which are formed on the front sheet so as to protrude outside, can be reversed inside, and each include an electrode provided therein;

a circuit member having a plurality of contact points with, each of the contact points being brought into contact with the corresponding electrode when the corresponding protuberance is reversed;

a spacer sheet which is interposed between the front sheet and the circuit member and includes a plurality of through holes, respectively corresponding to the plurality of protuberances, formed therein for ensuring contact between the electrode and the plurality of contact points, the spacer sheet including, an uppermost layer spacer sheet, and at least one lower layer spacer sheet interposed between the uppermost layer spacer sheet and the circuit member, wherein the plurality of through holes are communicated each other through at least one air release section formed through the at least one lower layer spacer sheet; and an adhesive sheet including at one side thereof a circuit member attachment surface to be adhered to the circuit member and at the other side an adhesive fixing surface to be attached to a mount member

(13) The dome switch according to (12), wherein the adhesive sheet includes a air release hole which communicates a space section formed in a mount surface of the mount member with the through hole for air release at the time of reversal of the protuberance.

According to the present invention, when one of the protuberances is depressed at the time of actuation of the switch and becomes reversed, the electrode provided on the interior surface of the protuberance is brought into contact with the contact point of the circuit member via the through hole formed in the spacer sheet. The spacer sheet acts as a member for preventing occurrence of deformation of a front sheet, as well as acting as a member for ensuring a stroke dimension of the protuberance. Accordingly, in order to increase a stroke of the protuberance, the only requirement is to increase the thickness of the spacer sheet within a range in which the protuberance can return to its original state. As a result, the depth of the through hole becomes greater, and the stroke dimension of the protuberance can be made greater. Naturally, deformation of the front sheet is prevented. The spacer sheet has an important function for maximizing the stroke of the protuberance.

According to the present invention, the dome switch is constituted of a spacer sheet made of a plurality of spacer sheets. As a result, the thickness of the spacer sheet can be changed, by means of changing, e.g., the number of layers, thereby facilitating adjustment of stroke dimension of a protuberance. Further, the poly-dome switch can possess more flexibility than can a poly-dome switch constituted of a single layer.

According to the present invention, the dome switch is constituted of a spacer sheet made of a plurality of spacer sheets. As a result, the thickness of the spacer sheet can be changed, by means of changing, e.g., the number of layers, thereby facilitating adjustment of stroke dimension of a protuberance. There is formed a dome switch, wherein the uppermost spacer sheet facing the front sheet is formed thinner than one or a plurality of lower-layer spacer sheets.

According to the present invention, the dome switch is constituted of a spacer sheet made of a plurality of spacer sheets. As a result, the thickness of the spacer sheet can be changed, by means of changing, e.g., the number of layers, thereby facilitating adjustment of stroke dimension of a protuberance. There is yielded a dome switch, wherein no air release section is formed in the uppermost layer spacer sheet facing the front sheet. As a result, there is obviated from the front sheet an edge, which would otherwise be caused by the air release sections. Hence, the front sheet can be protected when the protuberance is reversed. There can be minimized deformation of the front sheet, which arises in the periphery of the through hole when the protuberance is reversed. Since the air release sections are formed in one or a plurality of lower-layer spacer sheets, there is maintained a tactile click which arises at the time of actuation of the switch.

According to the present invention, the dome switch is constituted of a spacer sheet made of a plurality of spacer sheets. As a result, the thickness of the spacer sheet can be changed, by means of changing, e.g., the number of layers, thereby facilitating adjustment of stroke dimension of a protuberance. There is formed a dome switch, wherein limitations are imposed on the diameter of each through hole formed in the spacer sheet. As a result, there can be minimized deformation of the front sheet, which arises in the periphery of the through hole when the protuberance is reversed.

According to the present invention, when a protuberance is reversed toward the circuit member as a result of actuation of the switch, air which has remained inside the protuberance thus far escapes to the air release section of the spacer sheet via the through holes formed in the spacer sheet. The air release section is in communication with the space section of the mount member via the air release holes formed in the circuit member and those formed in the adhesive sheet. The space section of the mount member is utilized as a space for air release purpose at the time of reversal of a protuberance.

According to the present invention, when a protuberance is reversed toward the circuit member as a result of actuation of the switch, air which has remained inside the protuberance thus far escapes to the air release section of the spacer sheet via the through holes formed in the spacer sheet. Unlike the through holes of the lower-layer spacer sheets, the through holes of the uppermost spacer sheet are not provided with the air release section. Hence, at the time of actuation of the switch, no deformation or deformation arises in the front sheet in the periphery of the through hole. Further, unlike the through holes of the lower-layer spacer sheets, the through holes of the uppermost spacer sheet are not provided with the air release section. Hence, the through holes of the lower-layer spacer sheets can be made larger in diameter than those of the uppermost spacer sheet, thus broadening the space for air release purposes.

According to the present invention, the air release section of the lower-layer spacer sheets is in communication with the space section of the mount member via the air release holes formed in the circuit member and those of the adhesive sheet. The space section of the mount member is utilized as a space for air release purposes at the time of reverse of a protuberance.

BRIEF DESCRIPTION OF THE DRAWINGS

FIG. 6 is a cross-sectional view showing the principal section of the poly-dome switch according to the third embodiment before actuation of the switch;

FIG. 7 is a cross-sectional view showing the principal section of the poly-dome switch according to the third embodiment at the time of actuation of the switch;

FIG. 16 is a cross-sectional view showing the principal section of the poly-dome switch according to the seventh embodiment before actuation of the switch;

FIG. 17 is a cross-sectional view showing the principal section of the poly-dome switch according to the seventh embodiment at the time of actuation of the switch;

DETAILED DESCRIPTION OF PREFERRED EMBODIMENTS

Embodiments of the present invention will now be described by reference to the accompanying drawings.

Fist Embodiment

Figure 1:
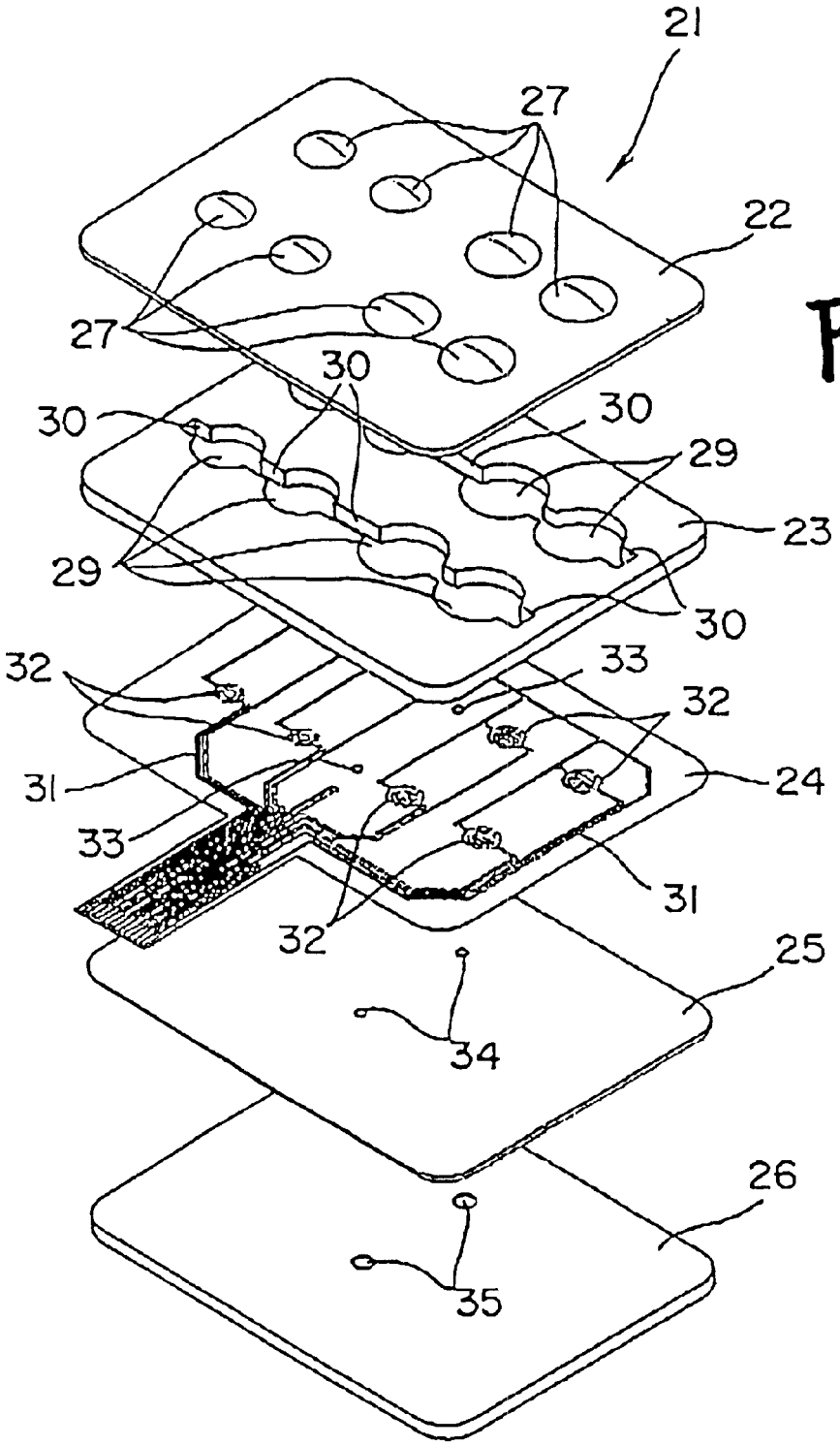
FIG. 1 is an exploded perspective view showing a first embodiment of a dome switch according to the present invention.
Figure 2:
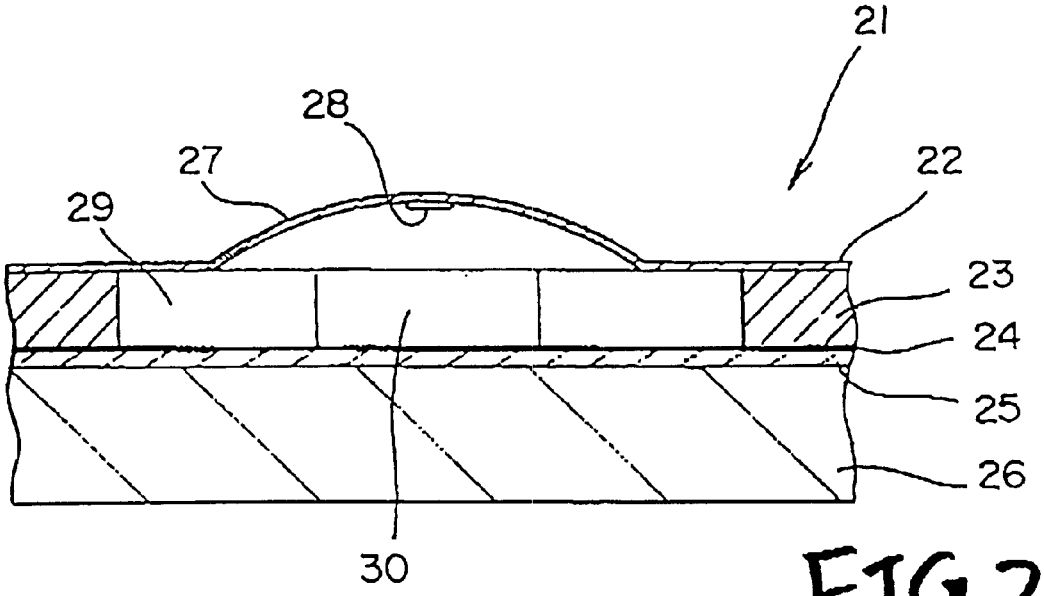
FIG. 2 is a cross-sectional view of the principal section before the dome switch according to a first embodiment is actuated.
Figure 3:
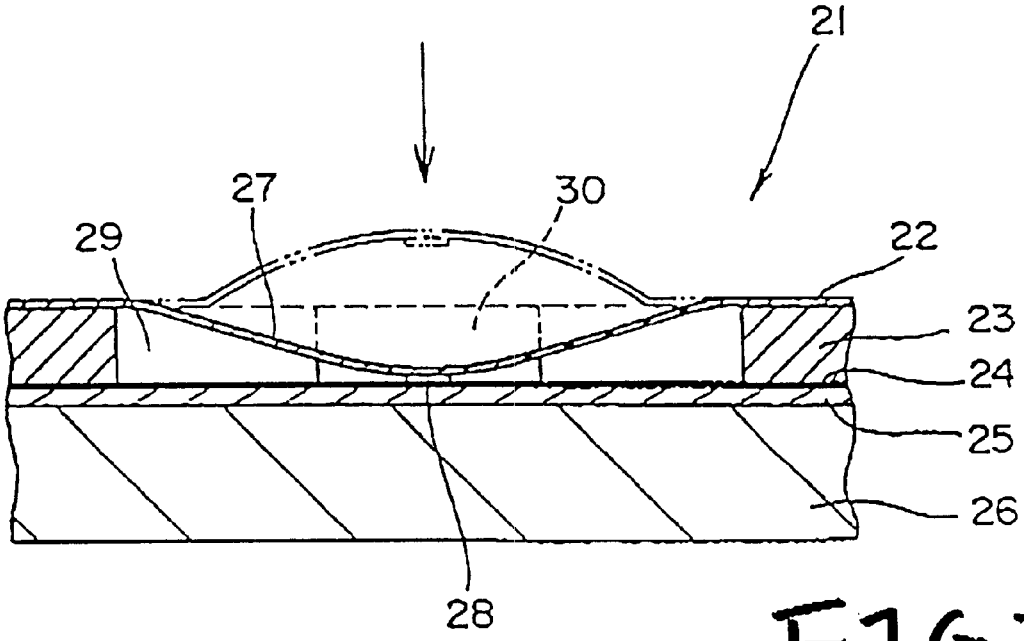
FIG. 3 is across-sectional view of the principal section at the time of actuation of the dome switch according to the first embodiment.

FIG. 1 is an exploded perspective view showing a first embodiment of a dome switch according to the present invention. FIG. 2 is across-sectional view of the principal section before the dome switch according to the first embodiment is actuated. FIG. 3 is a cross-sectional view of the principal section at the time of actuation of the dome switch according to the first embodiment.

Referring to FIG. 1, a poly-dome switch (corresponding to a dome switch in claims) designated by reference numeral 21 fulfills a high stroke required for equipment to be mounted on a vehicle; e.g., an automobile. The poly-dome switch 21 comprises a front sheet 22, a spacer sheet 23, an FPC 24, and an adhesive sheet 25. The poly-dome switch 21 is fixed through the adhesive sheet 25 to a plate 26, which is an example mount member to be attached to a vehicle, for example. The plate 26 may be incorporated into the structure of the poly-dome switch 21 (if the plate 26 is the same as that illustrated, the plate may be included in the poly-dome switch 21).

The constituent members of the dome switch 21 will first be described in detail, and the operation of the dome switch 21 will next be described.

The front sheet 22 includes a plurality of protuberances 27. Each of the protuberances 27 is formed into the shape of a dome such that the dome protrudes outside and can be inverted inside. An electrode 28 (see FIG. 2) for to the FPC 24 is provided on the interior surface of each protuberance 27. The electrode (see FIG. 2) is provided on top of the interior surface.

The front sheet 22 will be described in more detail. The front sheet 22 is made of synthetic resin; e.g., polyethylene terephthalate (PET). The front sheet 22 includes the plurality of dome-shaped protuberances 27 which have been formed by thermal pressing (applying pressure from the inside of the front sheet 22 to the outside). The electrode 28 provided on the top of the interior surface of each dome-shaped protuberance 27 is made of carbon (in the case of carbon-made electrodes 28, the electrode 28 is provided by printing).

The spacer sheet 23 is a thick sheet member made of synthetic resin; e.g., polyethylene terephthalate (PET). As in the case of the related-art example, the spacer sheet 23 has the function as a member for preventing occurrence of deformation of the front sheet 22. Unlike the related-art example of a spacer sheet, the spacer sheet 23 has the function of serving as a member for ensuring a stroke dimension of the protuberance 27. More specifically, the spacer sheet 23 is formed into the shape of a sheet having about half a thickness which enables the protuberance 27 to assume the maximum stroke. In the present embodiment, the front sheet 22 has a thickness of 125 μm (excluding the height of the protuberance 27). The maximum stroke available for the protuberance 27 is 1.5 mm (where the height of the protuberance 27 is 750 μm), and the spacer sheet 23 has a thickness of 750 μm.

The spacer sheet 23 will be described in more detail. An unillustrated adhesive layer is provided on either surface of the spacer sheet 23. The front sheet 22 can be fixed to one of two surfaces of the spacer sheet 23, and the FPC 24 can be fixed to the remaining surface of the spacer sheet 23. The spacer sheet 23 includes a plurality of through holes 29 and a plurality of air release sections 30, thereby enabling passage of each protuberance 27 at the time of inversion. When a protuberance 27 is inverted, air remaining inside the protuberance 27 can be released, as required.

As shown in FIG. 2, each through hole 29 is formed so as to match in position with the corresponding protuberance 27. Each through hole 29 is formed so as to become larger in diameter than the corresponding protuberance 27 (each through hole 29 may be identical in diameter with the corresponding protuberance 27). Each air release section 30 is in the shape of a slit, and the air release sections 30 are formed between the through holes 29 arranged in the longitudinal direction of the spacer sheet 23. Each air release section 30 is formed so as to be in communication with a corresponding through hole 29.

The FPC (flexible print circuit) 24 is a circuit member including a plurality of circuits 31 to be designed into desired patterns. The surface of the FPC 24 facing the spacer sheet 23 is provided with a plurality of contact points 32 with which the electrodes 28 (see FIG. 2) are to be brought into contact. The FPC 24 includes air release holes 33, 33 which are in communication with the air release sections 30 formed in the spacer sheet 23. In the present embodiment, the FPC 24 has a thickness of 100 μm. The circuit member is not limited to an FPC (FPC 24).

The adhesive sheet 25 is formed so that the FPC 24 can be bonded to the adhesive sheet 25. The adhesive sheet 25 is formed so as to be fixedly bonded to the plate 26. The adhesive sheet 25 has the function as a reinforcement member. Air release holes 34, 34 analogous to the air release holes 33, 33 are formed in the adhesive sheet 25 so as to be in communication with the air release holes 33, 33 of the FPC 24. The air release holes 34, 34 are in communication with air release sections 35, 35 formed in the plate 26.

The poly-dome switch 21 having the foregoing construction is assembled in the following manner. First, the front sheet 22 is fixedly bonded to the front surface of the spacer sheet 23, and the FPC 24 is bonded to the back of the spacer sheet 23. The thus-produced assembly is bonded to the surface of the adhesive sheet 25 facing the FPC 24. Thus, assembly of the poly-dome switch 21 is completed.

Operation of the poly-dome switch 21 will now be described by reference to FIGS. 2 and 3.

Referring to FIG. 2, when no load is imposed on the protuberance 27; that is, before actuation of the poly-dome switch 21, the geometry of the protuberance 27 is maintained by virtue of the shape-retaining characteristic thereof.

Referring to FIG. 3, when the protuberance 27 is depressed in the direction of the arrow as a result of actuation of the switch (i.e., load is imposed in the direction of the arrow), the protuberance 27 opposes against the load and buckles to become reverse upon receipt of a certain load (at this time, the user feels a tactile click). The load imposed in the direction of the arrow diminishes as a result of buckling and reverse of the protuberance 27, so that the protuberance 27 is depressed smoothly. The thus-reversed protuberance 27 passes through the through hole 29 formed in the spacer sheet 23, and the electrode 28 attached to the protuberance 27 is brought into contact with a contact point 32 of the FPC 24 through the through hole 29 (see FIG. 1). Thus, the poly-dome switch 21 is turned on. When the load imposed in the direction of the arrow is released, the protuberance 27 returns to its original state.

The poly-dome switch 21 according to the present embodiment causes the spacer sheet 23 to act not only as a member for preventing occurrence of deformation of the front sheet 22, but also as a member for ensuring a stroke dimension of the protuberance 27. So long as a required stroke dimension is ensured by increasing the thickness of the spacer sheet 23 in the manner as mentioned above, the stroke dimension of the protuberance 27 can be increased. Needless to say, depending on the thickness of the spacer sheet 23, the stroke dimension of the protuberance 27 required at the time of actuation of the poly-dome switch 21 can be set to a required dimension.

Second Embodiment

Figure 4:
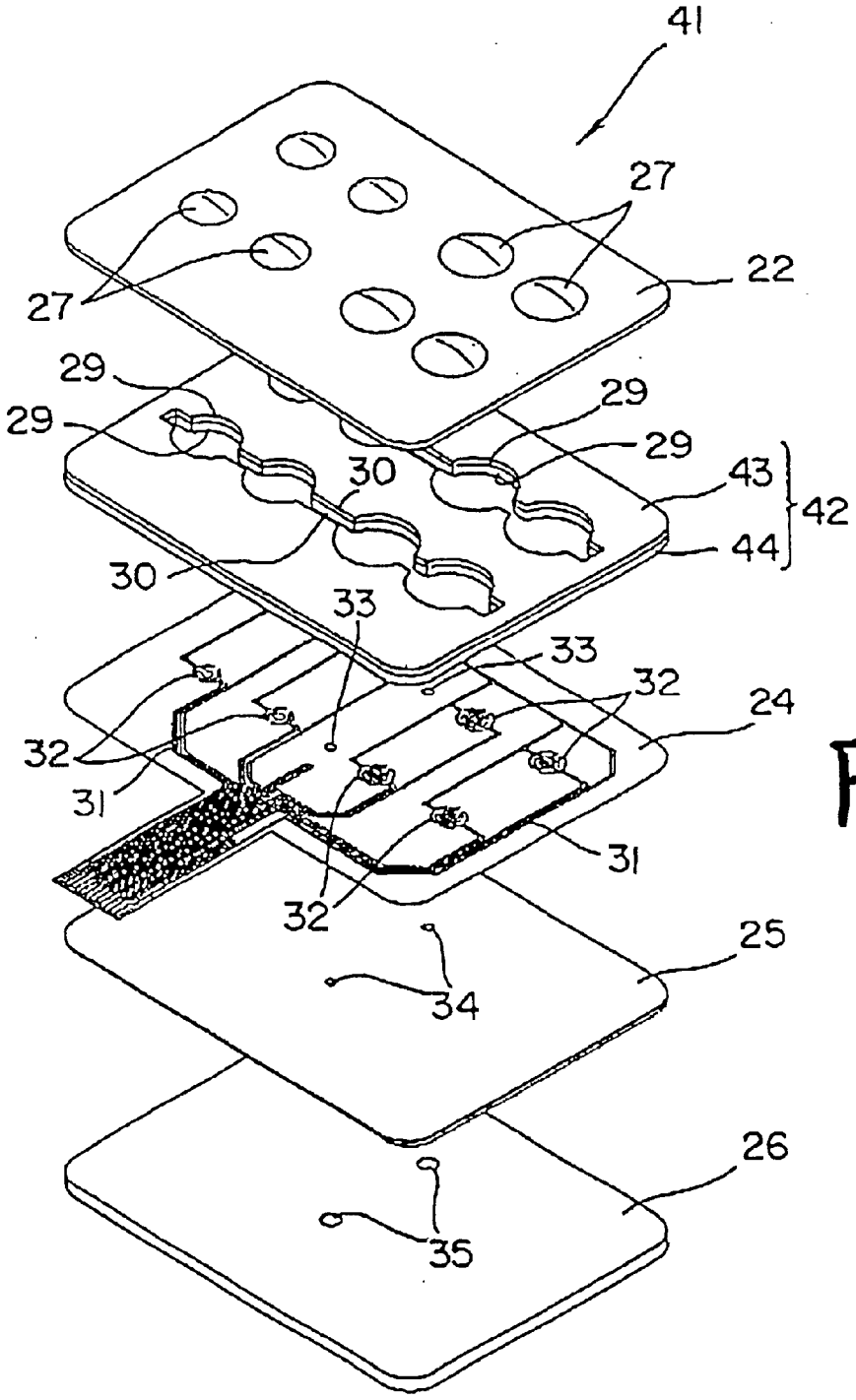
FIG. 4 is an exploded perspective view showing a second embodiment of the dome switch according to the present invention.

By reference to FIG. 4, a dome switch according to a second embodiment of the present invention will now be described. FIG. 4 is an exploded perspective view showing a second embodiment of the dome switch according to the present invention. Those elements which are essentially the same as the constituent elements of the poly-dome switch 21 in the first embodiment are assigned the same reference numerals, and their explanations are omitted.

Referring to FIG. 4, a poly-dome switch designated by reference numeral 41 (corresponding to a dome switch described in claims) implements an increase in the stroke required for a switch of equipment to be mounted on a vehicle; e.g., an automobile, as in the case of the poly-dome switch 21 (see FIG. 1). The poly-dome switch 41 comprises the front sheet 22; a spacer sheet 42; the FPC 24; and the adhesive sheet 25. The poly-dome switch 41 is fixed to the plate 26, which serves as an example mount member employed in a vehicle, via the adhesive sheet 25. As mentioned previously, the plate 26 may be included in the structure of the poly-dome switch 41.

The spacer sheet 42 comprises an upper-layer spacer sheet 43 and a lower-layer spacer sheet 44. More specifically, the spacer sheet 42 is formed into a two-layer structure. As in the case of the spacer sheet 23 (see FIG. 1), the spacer sheet 42 has the function as a member for preventing occurrence of deformation of the front sheet 22 and the function as a member for ensuring the stroke dimension of the protuberance 27. The upper-layer spacer sheet 43 and the lower-layer spacer sheet 44 may be made of a sheet member of synthetic resin; e.g., polyethylene terephthalate (PET). The upper-layer spacer sheet 43 is formed thinner than the lower-layer spacer sheet 44. In the present embodiment, the upper-layer spacer sheet 43 has a thickness of 150 μm, and the lower-layer spacer sheet 44 has a thickness of 300 μm. The upper-layer spacer sheet 43 acts as a sheet member for effecting fine adjustment at the time of ensuring the stroke dimension of the protuberance 27. The upper-layer spacer sheet 43 corresponds to the uppermost spacer sheet described in claims.

An unillustrated adhesive layer is provided on either surface of the upper-layer spacer sheet 43. Hence, the front sheet 22 can be bonded to the front surface of the upper-layer spacer sheet 43, and the lower-layer spacer sheet 44 can be bonded to the back of the upper-layer space sheet 43. The upper-layer spacer sheet 43 has a plurality of through holes 29 and a plurality of air release sections 30.

Since an unillustrated adhesive layer is provided on either surface of the lower-layer spacer sheet 44, the upper-layer spacer sheet 43 can be bonded to the front surface of the lower-layer spacer sheet 44, and the FPC 24 can be bonded to the back of the lower-layer space sheet 44. The lower-layer spacer sheet 44 has a plurality of through holes 29 and a plurality of air release sections 30 in the same manner as does the upper-layer spacer sheet 43 (the through holes 29 formed in the lower-layer spacer sheet 44 are equal or larger in diameter than those formed in the upper-layer spacer sheet 43; the greater the diameter of the through hole 29, the larger an area can be ensured for air release purposes, therefore the tactile click is not impaired).

When the upper-layer spacer sheet 43 and the lower-layer spacer sheet 44 are overlaid one on top of the other, to thereby constitute the spacer sheet 42, the through holes 29 and the air release sections 30 formed in the upper-layer spacer sheet 43 are matched to those formed in the lower-layer spacer sheet 44.

The poly-dome switch 41 having the foregoing construction is assembled in the following manner. The upper-layer spacer sheet 43 and the lower-layer spacer sheet 44 are bonded together, thereby forming the spacer sheet 42. Next, the front sheet 22 is bonded to the front surface of the spacer sheet 42 (in reality, the upper-layer spacer sheet 43). The FPC 24 is bonded to the back of the spacer sheet 42 (in reality, the lower-layer spacer sheet 44). Subsequently, the thus-produced assembly is bonded to the surface of the adhesive sheet 25 facing the FPC 24 Thus, assembly of the poly-dome switch 41 is completed.

Since the poly-dome switch 41 operates-in the same manner as does the poly-dome switch 21 in the first embodiment, the explanation of the operation is omitted (the only difference between them is a change in the stroke dimension of the protuberance 27 ensured by the spacer sheet 42).

The poly-dome switch 41 according to the second embodiment acts as a member for ensuring the stroke dimension of the protuberance 27, as well as acting as a member for preventing occurrence of deformation of the front sheet 22 of the spacer sheet 42. As in the case of the poly-dome switch 21, the poly-dome switch 41 can realize an increase in the stroke dimension of the protuberance 27. The spacer sheet 42 is constituted by the upper-layer spacer sheet 43 and the lower-layer spacer sheet 44. Hence, the poly-dome switch 41 according to the second embodiment can possess more flexibility than can a poly-dome switch constituted by a single layer. Further, adjustment of the stroke dimension of the protuberance 27 to be ensured can be facilitated (in other words, adjustment of the stroke dimension of the protuberance 27 to be ensured can be facilitated by means of offering variation in the thicknesses of the upper-layer and lower-layer spacer sheets 43 and 44 and selecting either the upper-layer spacer sheet 43 or the lower-layer spacer sheet 44 depending on a required purpose, or by means of increasing/decreasing the thicknesses of the spacer sheets 43 and 44). The upper-layer spacer sheet 43 is caused to act as a sheet member for fine adjustment at the time of ensuring the stroke dimension of the protuberance 27. Accordingly, the poly-dome switch 41 according to the second embodiment enables easy fine-adjustment of the stroke dimension of the protuberance 27 (in other words, the stroke dimension of the protuberance 27 can be finely adjusted by offering variation in the thicknesses of the upper-layer and lower-layer spacer sheets 43 and 44 and selecting an appropriate thickness depending on a required purpose).

Third Embodiment

Figure 5:
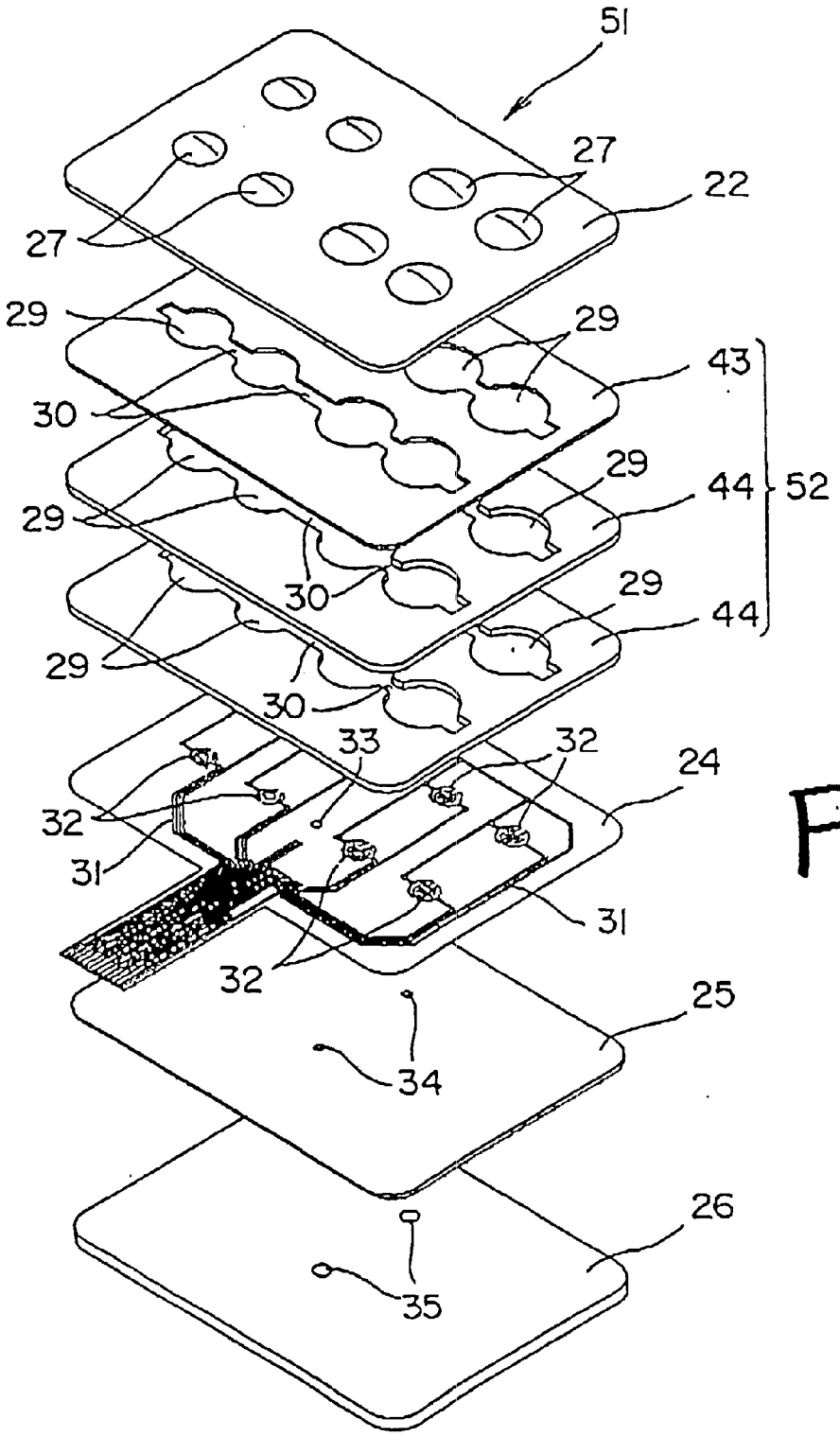
FIG. 5 is an exploded perspective view showing a third embodiment of the dome switch according to the present invention.

Referring to FIG. 5, a dome switch according to a third embodiment of the present invention will now be described. FIG. 5 is an exploded perspective view showing a third embodiment of the dome switch according to the present invention. Those elements which are essentially the same as the constituent elements of the poly-dome switch 21 and those of the poly-dome switch 41 in the first and second embodiments are assigned the same reference numerals, and their explanations are omitted.

Referring to FIG. 5, a poly-dome switch designated by reference numeral 51 (corresponding to a dome switch in claims) implements an increase in the stroke required for a switch of equipment to be mounted on a vehicle; e.g., an automobile, as in the case of the poly-dome switch 21 (see FIG. 1) and the poly-dome switch 41 (see FIG. 4). The poly-dome switch 51 comprises the front sheet 22; a spacer sheet 52; the FPC 24; and the adhesive sheet 25. The poly-dome switch 51 is fixed to the plate 26, which serves as an example mount member employed in a vehicle, for example, through the adhesive sheet 25. As mentioned previously, the plate 26 may be included in the structure of the poly-dome switch 51.

The spacer sheet 52 comprises an upper-layer spacer sheet 43 and lower-layer spacer sheets 44, 44. More specifically, the spacer sheet 52 is formed into a three-layer structure. As in the case of the spacer sheet 23 (see FIG. 1; first embodiment) or the spacer sheet 42 (see FIG. 4; second embodiment), the spacer sheet 52 has the function as a member for preventing occurrence of deformation of the front sheet 22 and the function as a member for ensuring the stroke dimension of the protuberance 27. In the present embodiment, the spacer sheet 52 has a total thickness of 750 $\mu$m including the thicknesses of the three spacer sheets 43, 44, and 44 (i.e., the spacer sheet 52 becomes equal in thickness to the spacer sheet 23 in the first embodiment; in other words, the protuberance 27 has about half the maximum stroke dimension).

The poly-dome switch 51 having the foregoing construction is assembled in the following manner. First, the upper-layer spacer sheet 43 and the lower-layer spacer sheets 44, 44 are bonded together, thereby constituting the spacer sheet 52. Next, the front sheet 22 is bonded to the front surface of the spacer sheet 52 (in reality, to the upper-layer spacer sheet 43). The FPC 24 is bonded to the back of the spacer sheet 52 (in reality, to the lower-layer spacer sheet 44 serving as the lowermost layer). Subsequently, the thus-produced assembly is bonded to the surface of the adhesive sheet 25 facing the FPC 24. Now, assembly of the poly-dome switch 25 is completed.

The operation of the poly-dome switch 51 is now described by reference to FIGS. 6 and 7. FIG. 6 is a cross-sectional view showing the principal section of the poly-dome switch 51 according to the third embodiment before actuation of the switch. FIG. 7 is across-sectional view showing the principal section of the poly-dome switch 51 according to the third embodiment at the time of actuation of the switch.

Referring to FIG. 6, when no load is imposed on the protuberance 27; that is, before actuation of the poly-dome switch 21, the geometry of the protuberance 27 is maintained by virtue of the shape-retaining characteristic thereof.

Referring to FIG. 7, when the protuberance 27 is depressed in the direction of the arrow as a result of actuation of the switch (i.e., load is imposed in the direction of the arrow), the protuberance 27 opposes the load and buckles to become reverse upon receipt of a certain load (at this time, the user feels a tactile click). The load imposed in the direction of the arrow diminishes as a result of buckling and reverse of the protuberance 27, so that the protuberance 27 is depressed smoothly. The thus-reversed protuberance 27 passes through the through hole 29 formed in the spacer sheet 52, and the electrode 28 attached to the protuberance 27 is brought into contact with the contact point 32 (see FIG. 5) of the FPC 24 through the through hole 29, thereby bringing the circuit 31 (see FIG. 5) into conduction. Thus, the poly-dome switch 51 is turned on. When the load imposed in the direction of the arrow is released, the protuberance 27 returns to its original state.

The poly-dome switch 51 according to the third embodiment causes the spacer sheet 52 to act not only as a member for preventing occurrence of deformation of the front sheet 22, but also as a member for ensuring a stroke dimension of the protuberance 27. As a result, the stroke dimension of the protuberance 27 can be increased, as in the case of the poly-dome switch 21 and 41 in the first and second embodiments. In relation to the poly-dome switch 51, the spacer sheet 52 is constituted of the upper-layer spacer sheet 43 and the lower-slayer spacer sheets 44, 44. Hence, the poly-dome switch 51 according to the third embodiment can possess more flexibility than that possessed by a poly-dome switch constituted of a single layer. Adjustment of the stroke dimension of the protuberance 27 to be ensured can be facilitated (in other words, adjustment of the stroke dimension of the protuberance 27 to be ensured can be facilitated by offering variation in the thicknesses of the upper-layer and lower-layer spacer sheets 43 and 44 and selecting either the upper-layer spacer sheet 43 or the lower-layer spacer sheet (s) 44 depending on a required purpose or increasing/decreasing the thicknesses of the spacer sheets 43 and 44). The upper-layer spacer sheet 43 is caused to act as a sheet member for fine adjustment at the time of ensuring the stroke dimension of the protuberance 27. Accordingly, the poly-dome switch 51 according to the third embodiment enables easy fine adjustment of the stroke dimension of the protuberance 27 (in other words, the stroke dimension of the protuberance 27 can be finely adjusted by offering variation in the thicknesses of the upper-layer and lower-layer spacer sheets 43 and 44 and selecting an appropriate thickness depending on a required purpose).

Fourth Embodiment

Figure 8:
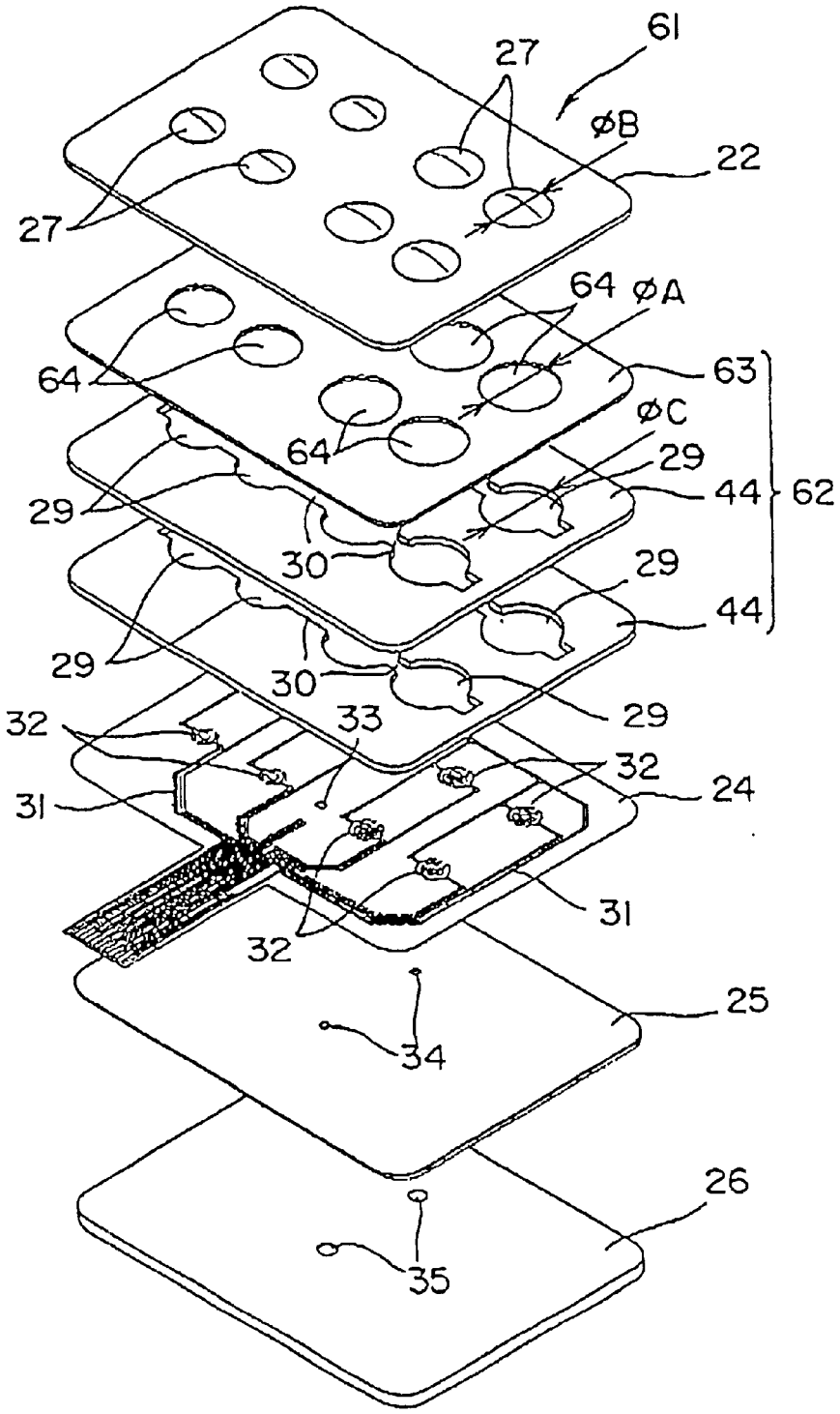
FIG. 8 is an exploded perspective view showing a fourth embodiment of the dome switch according to the present invention.

By reference to FIG. 8, a dome switch corresponding to a fourth embodiment of the present invention will now be described. FIG. 8 is an exploded perspective view showing a fourth embodiment of the dome switch according to the present invention. Those elements which are essentially the same as the constituent elements of the poly-dome switch 21, those of the poly-dome switch 41, and those of the poly-dome switch 51 in the first to third embodiments are assigned the same reference numerals, and their explanations are omitted.

Referring to FIG. 8, a poly-dome switch designated by reference numeral 61 (corresponding to a dome switch in claims) implements an increase in the stroke required for a switch of equipment to be mounted on a vehicle; e.g., an automobile, as in the case of the poly-dome switch 21 (see FIG. 1), the poly-dome switch 41 (see FIG. 4), or the poly-dome switch 51 (see FIG. 5). The poly-dome switch 61 comprises the front sheet 22; a spacer sheet 62; the FPC 24; and the adhesive sheet 25. The poly-dome switch 61 is fixed to the plate 26, which serves as an example mount member employed in a vehicle, through the adhesive sheet 25. As mentioned previously, the plate 26 may be included in the structure of the poly-dome switch 61.

The spacer sheet 62 comprises an upper-layer spacer sheet 63 and the lower-layer spacer sheets 44, 44. The spacer sheet 62 is formed into a three-layer structure. As in the case of the spacer sheet 23 (see FIG. 1; first embodiment), the spacer sheet 42 (see FIG. 4; second embodiment), or the spacer sheet 52 (see FIG. 5; third embodiment), the spacer sheet 62 has the function as a member for preventing occurrence of deformation of the front sheet 22 and the function as a member for ensuring the stroke dimension of the protuberance 27. In the present embodiment, the spacer sheet 62 has a total thickness of 750 $\mu$m, including the thicknesses of the three spacer sheets 63, 44, and 44 (i.e., the spacer sheet 62 becomes equal in thickness to the spacer sheet 23; in other words, the protuberance 27 has about half the maximum stroke dimension).

The upper-layer spacer sheet 63 may be made of a sheet member of synthetic resin; e.g., polyethylene terephthalate (PET). The upper-layer spacer sheet 63 is formed thinner than the lower-layer spacer sheet 44. In the present embodiment, the upper-layer spacer sheet 63 has a thickness of 150 $\mu$m. The upper-layer spacer sheet 63 acts as a sheet member for effecting fine adjustment at the time of ensuring the stroke dimension of the protuberance 27. (The upper-layer spacer sheet 63 corresponds to the uppermost spacer sheet in claims).

Since an unillustrated adhesive layer is provided on either surface of the upper-layer spacer sheet 63, the front sheet 22 can be bonded to the front surface of the upper-layer spacer sheet 63, and the lower-layer spacer sheet 44 can be bonded to the back of the upper-layer space sheet 63. The upper-layer spacer sheet 63 has a plurality of through holes 64. (The through holes 64 correspond to through holes described in claims, as the previously-mentioned through holes 29.)

The through holes 64 are formed in positions matched to those of corresponding protuberances 27. The diameter $\phi A$ of each through hole 64 is formed so as to become larger than or equal to the diameter $\phi B$ of the protuberance 27 ($\phi A \geqq \phi B$) In consideration of such a dimensional relationship, if the diameter $\phi A$ is set so as become equal to $\phi B$, there can be minimized deformation of the front sheet 22, which arises in the periphery of the through hole 64 when the protuberance 27 is reversed. The diameter $\phi A$ of each through hole 64 is formed so as to become smaller than or equal to the diameter $\phi C$ of each through hole 29 of the lower-layer spacer sheets 44, 44 ($\phi C \geqq \phi A$). In consideration of such a dimensional relationship, if the diameter $\phi A$ is set so as become larger than $\phi B$, there can be ensured a sufficient area for releasing air through the plurality of air release sections 30 formed in the lower-layer spacer sheet 44 unless air release sections 30 such as those formed in the lower-layer spacer sheet 44 are formed in the upper-layer spacer sheet 63 (which does not impair the tactile click). Since air release sections 30, such as those formed in the lower-layer spacer sheets 44, are not formed in the upper-layer spacer sheet 63, there is obviated an edge, which would otherwise be caused by the air release sections 30. Therefore, the front sheet 22 can be protected when the protuberance 27 is reversed.

The poly-dome switch 61 having the foregoing construction is assembled in the following manner. First, the upper-layer spacer sheet 63 and the lower-layer spacer sheets 44, 44 are bonded together, thereby constituting the spacer sheet 62. Next, the front sheet 22 is bonded to the front surface of the spacer sheet 62 (in reality, to the upper-layer spacer sheet 63). The FPC 24 is bonded to the back of the spacer sheet 62 (in reality, to the lower-layer spacer sheet 44 serving as the lower most layer). Subsequently, the thus-produced assembly is bonded to the surface of the adhesive sheet 25 facing the FPC 24. Now, assembly of the poly-dome switch 25 is completed.

Figure 9:
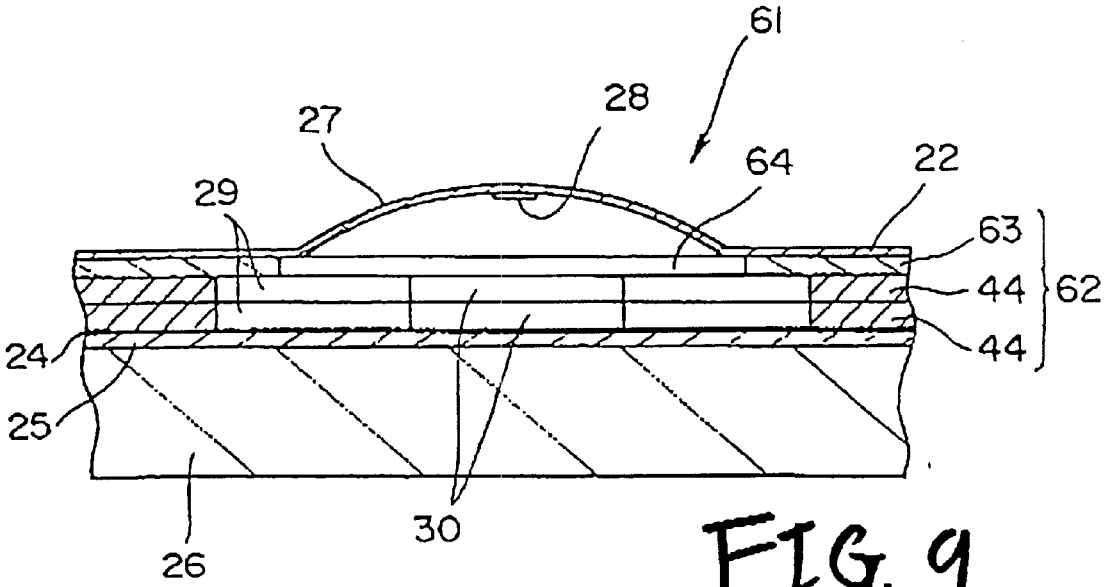
FIG. 9 is a cross-sectional view showing the principal section of the poly-dome switch according to the fourth embodiment before actuation of the switch.
Figure 10:
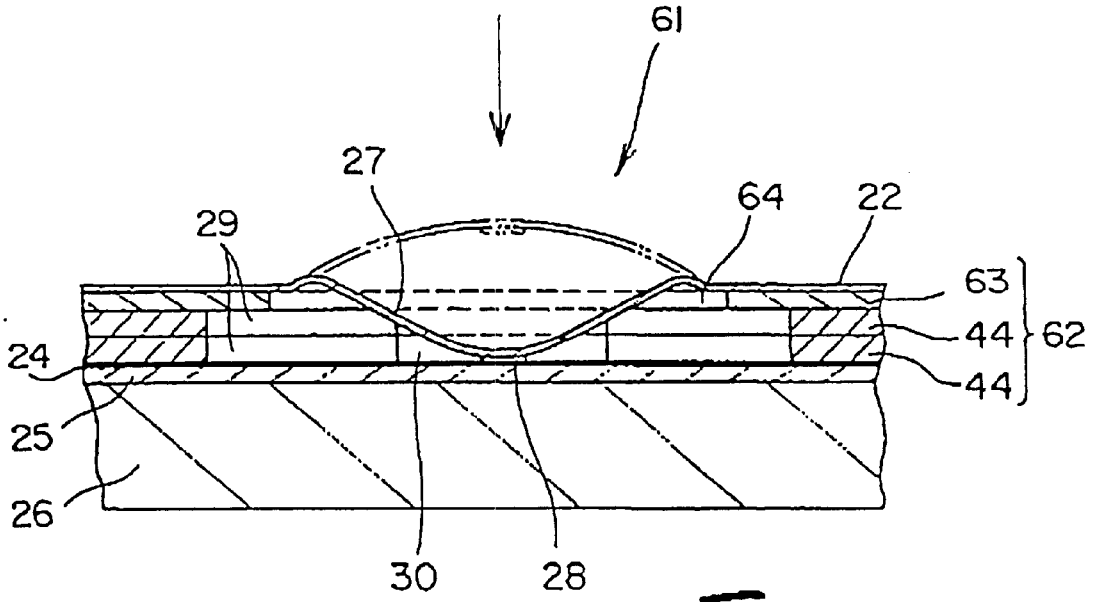
FIG. 10 is a cross-sectional view showing the principal section of the poly-dome switch according to the fourth embodiment at the time of actuation of the switch.

The operation of the poly-dome switch 61 is now described by reference to FIGS. 9 and 10. FIG. 9 is a cross-sectional view showing the principal section of the poly-dome switch 61 according to the fourth embodiment before actuation of the switch. FIG. 10 is a cross-sectional view showing the principal section of the poly-dome switch 61 according to the fourth embodiment at the time of actuation of the switch.

Referring to FIG. 9, when no load is imposed on the protuberance 27; that is, before actuation of the poly-dome switch 21, the geometry of the protuberance 27 is maintained by virtue of the shape-retaining characteristic thereof.

Referring FIG. 10, when the protuberance 27 is depressed in the direction of the arrow as a result of actuation of the switch (i.e., load is imposed in the direction of the arrow), the protuberance 27 opposes against the load and buckles to become reverse upon receipt of a certain load (at this time, the user feels a tactile click). The load imposed in the direction of the arrow diminishes as a result of buckling and reverse of the protuberance 27, so that the protuberance 27 is depressed smoothly. The thus-reversed protuberance 27 passes through the through holes 64 and 29 formed in the spacer sheet 62, and the electrode 28 attached to the protuberance 27 is brought into contact with the contact point 32 (see FIG. 8) of the FPC 24 through the through holes 64 and 29, thereby bringing the circuit 31 (see FIG. 8) into conduction. Thus, the poly-dome switch 61 is turned on. When the load imposed in the direction of the arrow is released, the protuberance 27 returns to its original state.

The poly-dome switch 61 according to the fourth embodiment causes the spacer sheet 62 to act not only as a member for preventing occurrence of deformation of the front sheet 22, but also as a member for ensuring a stroke dimension of the protuberance 27. Therefore, the stroke dimension of the protuberance 27 can be increased, as in the case of the poly-dome switch 21, 41, or 51. In relation to the poly-dome switch 61 according to the fourth embodiment, since the spacer sheet 62 is constituted by the upper-layer spacer sheet 63 and the lower-layer spacer sheets 44, 44, the poly-dome switch 61 according to the fourth embodiment can possess more flexibility than that possessed by a poly-dome switch constituted by a single layer. Adjustment of the stroke dimension of the protuberance 27 to be ensured can be facilitated (in other words, adjustment of the stroke dimension of the protuberance 27 to be ensured can be facilitated by offering variation in the thicknesses of the upper-layer and lower-layer spacer sheets 63 and 44 and selecting either the upper-layer spacer sheet 43 or the lower-layer spacer sheet(s) 44 depending on a required purpose or increasing/decreasing the thicknesses of the spacer sheets 43 and 44). The upper-layer spacer sheet 63 is caused to act as a sheet member for fine adjustment at the time of ensuring the stroke dimension of the protuberance 27. Accordingly, the poly-dome switch 61 according to the fourth embodiment enables easy fine adjustment of the stroke dimension of the protuberance 27 (in other words, the stroke dimension of the protuberance 27 can be finely adjusted by means of offering variation in the thicknesses of the upper-layer and lower-layer spacer sheets 63 and 44 and selecting an appropriate thickness depending on a required purpose). Further, the poly-dome switch 61 according to the fourth embodiment employs the upper-layer spacer sheet 63. Therefore, there can be provided the advantages of the ability to minimize deformation of the front sheet 22 in the periphery of the through hole 64, which would otherwise be caused when the protuberance 27 is reversed.

Fifth Embodiment

Figure 11:
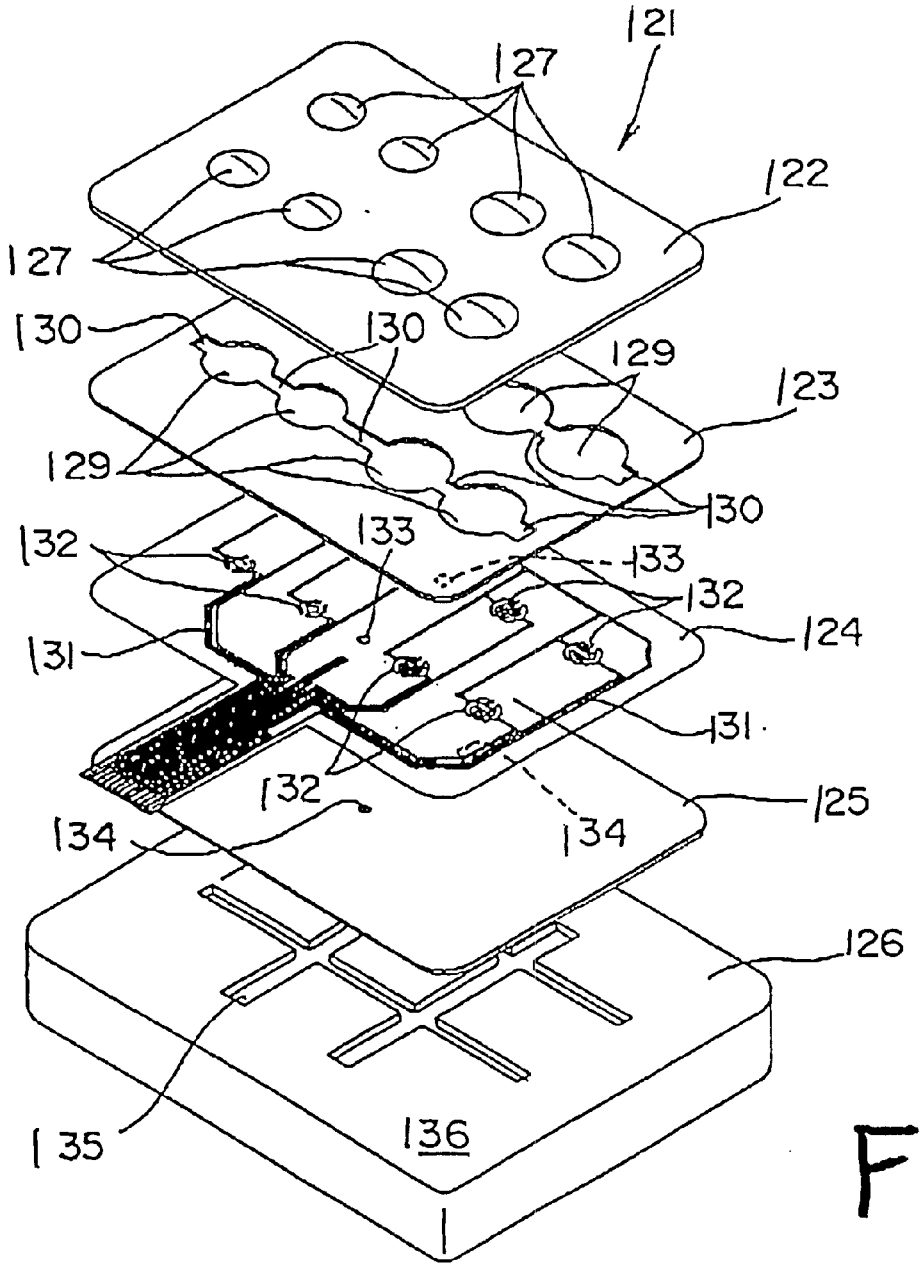
FIG. 11 is an exploded perspective view showing a fifth embodiment of an air release structure of a dome switch according to the present invention.
Figure 12:
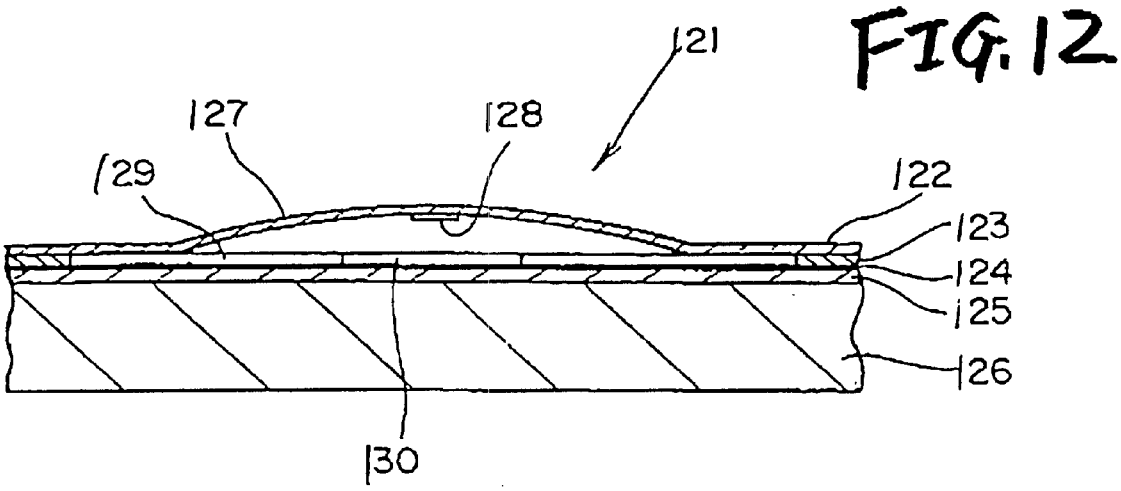
FIG. 12 is across-sectional view of the principal section before the dome switch according to the fifth embodiment is actuated.
Figure 13:
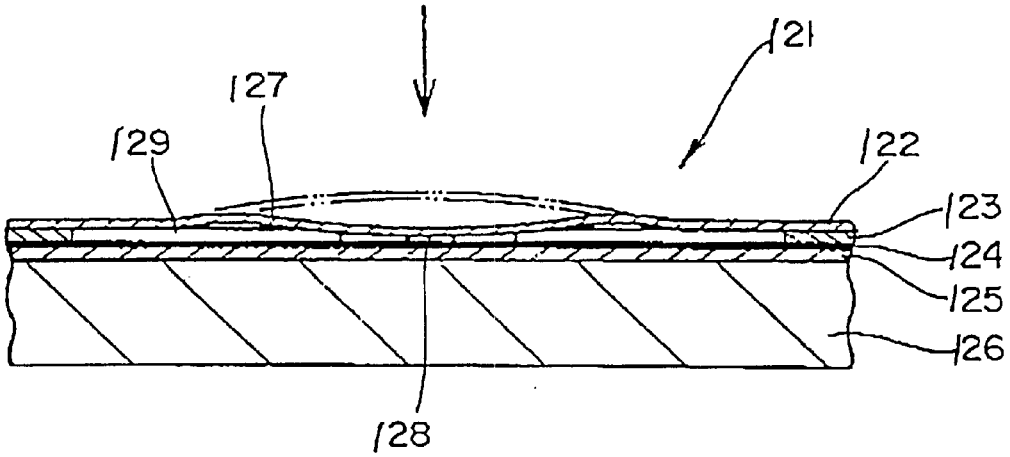
FIG. 13 is a cross-sectional view of the principal section at the time of actuation of the dome switch according to the fifth embodiment.

FIG. 11 is an exploded perspective view showing a fifth embodiment of a dome switch according to the present invention. FIG. 12 is a cross-sectional view of the principal section before the dome switch according to the fifth embodiment is actuated. FIG. 13 is a cross-sectional view of the principal section at the time of actuation of the dome switch according to the fifth embodiment.

By reference to FIG. 11, in the present embodiment, an air release structure used at the time of actuation of a switch is constituted of a poly-dome switch designated by reference numeral 121 (corresponding to a dome switch described in claims), and a housing 126 serving as a mount member to which the poly-dome 121 is to be attached.

Referring to FIG. 11, the poly-dome switch 121 comprises a front sheet 122, a spacer sheet 123, an FPC 124, and an adhesive sheet 125. The poly-dome switch 121 is fixed through the adhesive sheet 125 to the housing 126.

The constituent members of the dome switch 121 will first be described in detail, and the operation of the dome switch 121 will next be described.

The front sheet 122 includes a plurality of protuberances 127. Each of the protuberances 127 is formed into the shape of a dome such that the dome protrudes outside and can be inverted inside. An electrode 128 (see FIG. 12) for to the FPC 124 is provided on the interior surface of each protuberance 127. The electrode (see FIG. 12) is provided on top of the interior surface.

The front sheet 122 will be described in more detail. The front sheet 122 is made of synthetic resin; e.g., polyethylene terephthalate (PET). The front sheet 22 includes the plurality of dome-shaped protuberances 127 which have been formed by thermal pressing (applying pressure from the inside of the front sheet 122 to the outside). The electrode 128 provided on the top of the interior surface of each dome-shaped protuberance 127 is made of carbon (in the case of carbon-made electrodes 128, the electrode 128 is provided by printing).

The spacer sheet 123 is a thick sheet member made of synthetic resin; e.g., polyethylene terephthalate (PET). The spacer sheet 123 has the function as a member for preventing occurrence of deformation of the front sheet 122.

The spacer sheet 123 will be described in more detail. An unillustrated adhesive layer is provided on either surface of the spacer sheet 123. The front sheet 122 can be fixed to one of two surfaces of the spacer sheet 123, and the FPC 124 can be fixed to the remaining surface of the spacer sheet 123. The spacer sheet 123 includes a plurality of through holes 129 and a plurality of air release sections 30, thereby enabling passage of each protuberance 127 at the time of inversion. When a protuberance 127 is inverted, air remaining inside the protuberance 127 can be released, as required.

As shown in FIG. 12, each through hole 129 is formed so as to match in position with the corresponding protuberance 127. Each through hole 129 is formed so as to become larger in diameter than the corresponding protuberance 127 (each through hole 129 may be identical in diameter with the corresponding protuberance 127). Each air release section 130 is in the shape of a slit, and the air release sections 130 are formed between the through holes 129 arranged in the longitudinal direction of the spacer sheet 123. Each air release section 136 is formed so as to be in communication with a corresponding through hole 129.

The FPC (flexible print circuit) 124 is a circuit member including a plurality of circuits 131 to be designed into desired patterns. The surface of the FPC 124 facing the spacer sheet 123 is provided with a plurality of contact points 132 with which the electrodes 128 (see FIG. 12) are to be brought into contact. The FPC 124 includes air release holes 133, 133 which are in communication with the air release sections 130 formed in the spacer sheet 123. The circuit member is not limited to an FPC (FPC 124).

The adhesive sheet 125 is formed so that the FPC 124 can be bonded to the adhesive sheet 125. The adhesive sheet 125 is formed so as to be fixedly bonded to the housing 126. The adhesive sheet includes the surfaces, one of which is a circuit member attachment surface for the FPC 124, the other of which is an adhesive fixing surface for the housing 126. The adhesive sheet 125 has the function as a reinforcement member. Air release holes 134, 134 analogous to the air release holes 33, 33 are formed in the adhesive sheet 25 so as to be in communication with the air release holes 33, 33 of the FPC 24. The air release holes 34, 34 are in communication with air release sections 35, 35 formed in the plate 26.

The air release holes 133, 133 formed in the FPC 124 and the air release holes 134, 134 formed in the adhesive sheet 125 bring the air release section 130 of the spacer sheet 123 in communication with the space section 135 of the housing 126, as if to act as communication channels.

The housing 26 includes a mount surface 36 with which the adhesive attachment surface of the adhesive sheet 25 is brought into intimate contact. A space section 35 having; e.g., a recessed cross-sectional profile, is formed in the mount surface 36. The space section 35 is a dead space in the mount surface 36 and formed as a recess for preventing generation of a surface sink (i.e., for reducing a thickness) at the time of resin molding. A switch case or a like element is mentioned as a specific example of the housing 26.

The poly-dome switch 121 having the foregoing construction is assembled in the following manner. First, the front sheet 122 is fixedly bonded to the front surface of the spacer sheet 123, and the FPC 124 is bonded to the back of the spacer sheet 123. The thus-produced assembly is bonded to the circuit member attachment surface of the adhesive sheet 125 facing the FPC 124. Thus, assembly of the poly-dome switch 121 is completed. As mentioned above, the adhesive fixing surface of the adhesive sheet 125 is mounted, in a close contact manner, to the mounting surface 136 of the housing 126 so that the assembled poly-dome switch 121 is attached to the housing 126.

Operation of the poly-dome switch 121 will now be described by reference to FIGS. 12 and 13.

Referring to FIG. 12, when no load is imposed on the protuberance 127; that is, before actuation of the poly-dome switch 121, the geometry of the protuberance 127 is maintained by virtue of the shape-retaining characteristic thereof.

Referring to FIG. 13, when the protuberance 127 is depressed in the direction of the arrow as a result of actuation of the switch (i.e., load is imposed in the direction of the arrow), the protuberance 127 opposes against the load and buckles to become reverse upon receipt of a certain load (at this time, the user feels a tactile click). The load imposed in the direction of the arrow diminishes as a result of buckling and reverse of the protuberance 127, so that the protuberance 127 is depressed smoothly. The thus-reversed protuberance 127 passes through the through hole 129 formed in the spacer sheet 123, and the electrode 128 attached to the protuberance 27 is brought into contact with a contact point 32 of the FPC 124 through the through hole 129 (see FIG. 11). Thus, the poly-dome switch 121 is turned on. When the load imposed in the direction of the arrow is released, the protuberance 127 returns to its original state.

On the other hand, when the protuberance 127 is reversed toward the FPC 124 as a result of actuation of the switch, the air having remained within the protuberance 127 escapes to the space section 135 from the air release section 130 of the spacer sheet 123 through the through hole 129 of the spacer sheet 123.

As mentioned above, the air release structure in the poly-dome switch 121 employs the space section 135 of the housing 126 as a space for air release purposes at the time of reversal of the protuberance 127. Accordingly, the air release space is broadened, thus increasing the volume of the air release space. As a result, a tactile click can be improved.

As in the first to the fourth embodiments, the spacer sheet 123 is caused to act as a member for preventing occurrence of deformation of the front sheet 122 and as a member for ensuring a stroke dimension of the protuberance 27 (i.e., for ensuring a required stroke dimension for the protuberance 127 by increasing the thickness of the spacer sheet 123). As a result, the stroke of the protuberance 127 can be increased (i.e., an attempt is made to increase the stroke of the protuberance 127 in the same manner even in embodiments to be described later).

Sixth Embodiment

Figure 14:
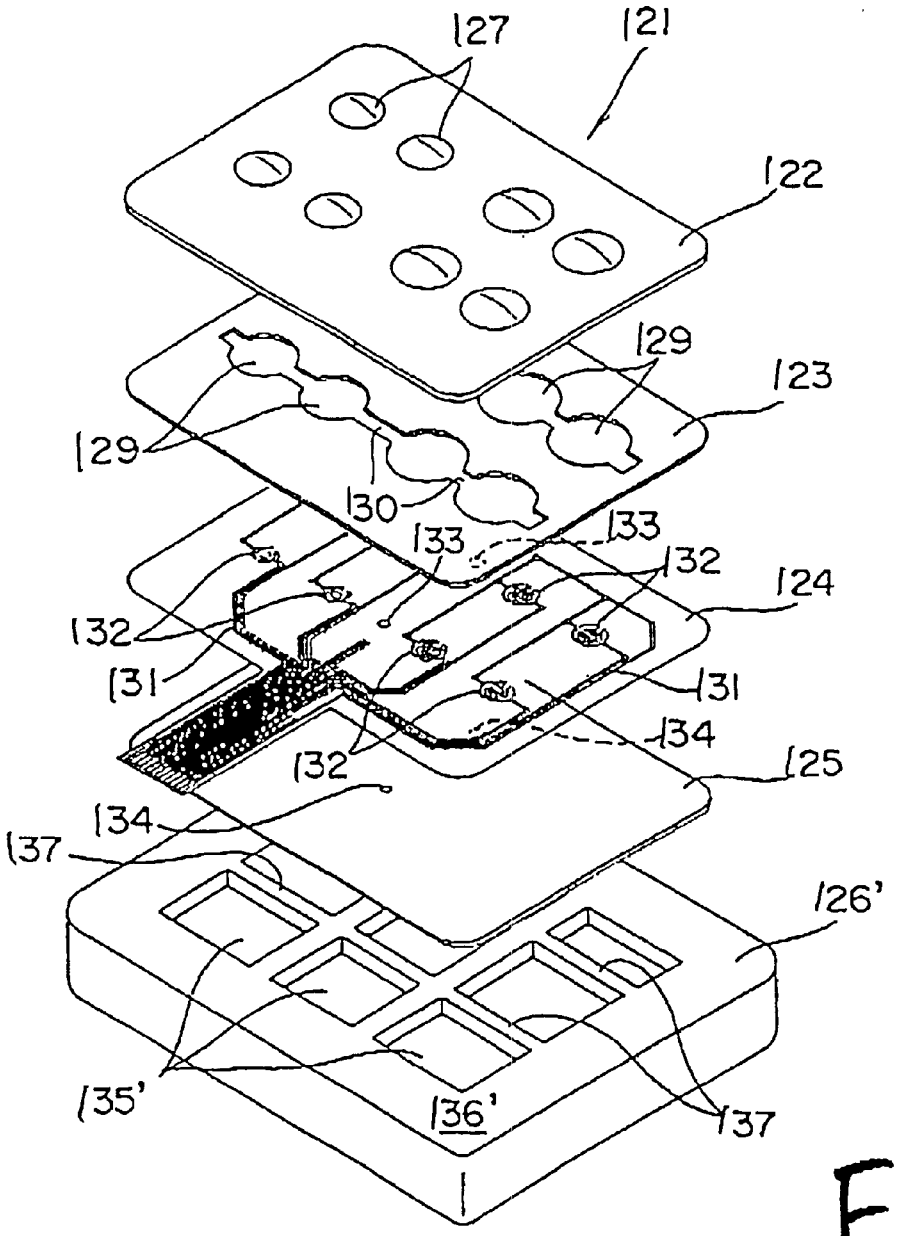
FIG. 14 is an exploded perspective view showing a sixth embodiment of the air release structure of the dome switch according to the present invention.

By reference to FIG. 14, a dome switch corresponding to a sixth embodiment of the present invention will now be described. FIG. 14 is an exploded perspective view showing the sixth embodiment of the air release structure in the dome switch according to the present invention. Those elements which are essentially the same as the constituent elements in the fifth embodiment are assigned the same reference numerals, and their explanations are omitted.

As shown in FIG. 14, in the second embodiment, an air release structure used at the time of actuation of a switch comprises the poly-dome switch 121, and a housing 126' serving as a mount member to which the poly-dome switch 121 is to be mounted.

In the sixth embodiment, each space section 135' of a housing 126' can be utilized as a space for air release purpose at the time of reversal of the protuberance 127 as mentioned in the fifth embodiment. The air release space is broadened as in the case of the fifth embodiment, and the volume of the space is increased. Thus, a tactile click can be improved.

Seventh Embodiment

Figure 15:
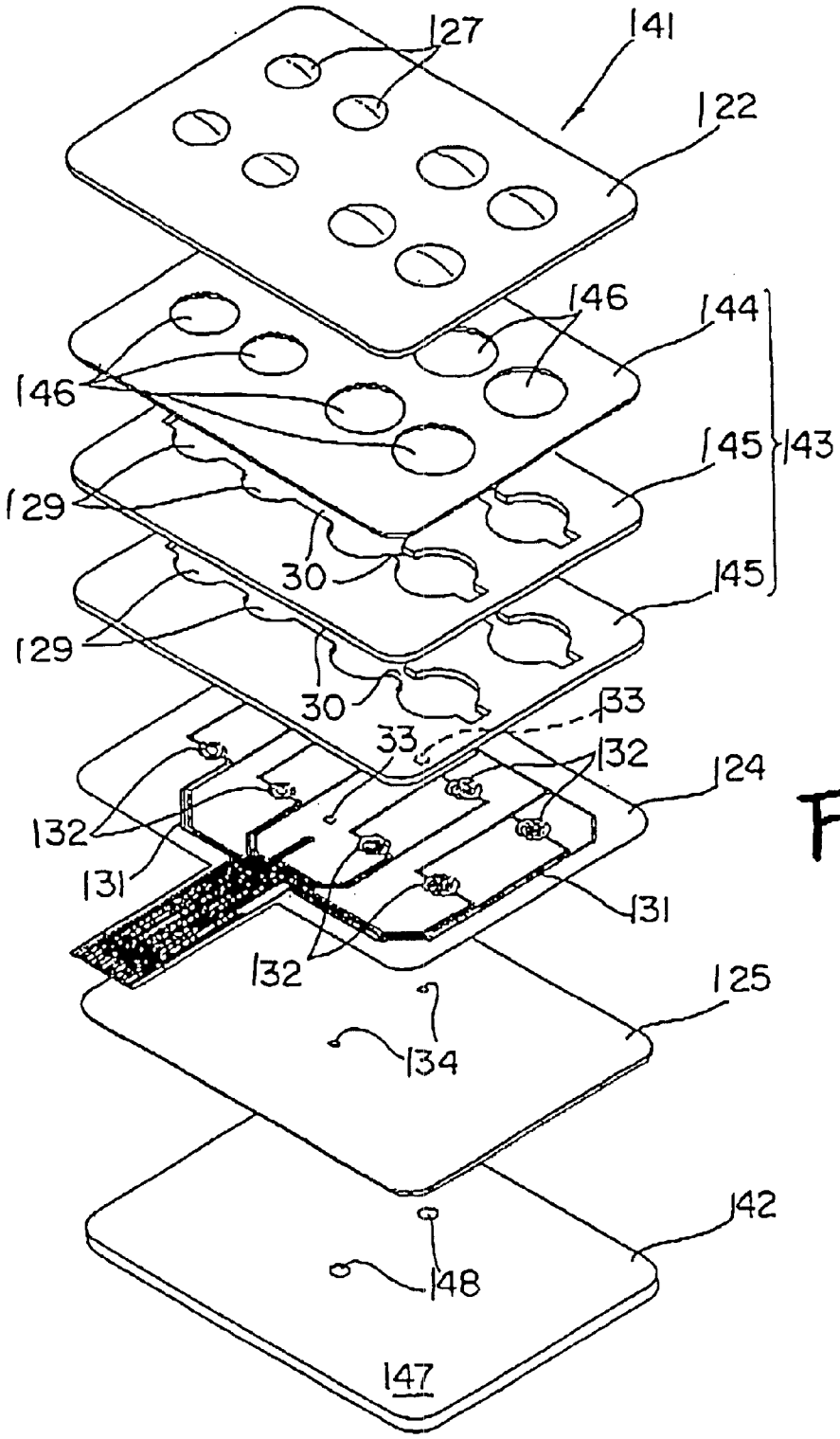
FIG. 15 is an exploded perspective view showing a seventh embodiment of the air release structure of the dome switch according to the present invention.

An air release structure in a dome switch according to a seventh embodiment of the present invention will now be described by reference to FIGS. 15 through 17. FIG. 15 is an exploded perspective view showing the seventh embodiment of the air release structure in the dome switch according to the present invention. FIG. 16 is a cross-sectional view showing the principal section of the poly-dome switch according to the seventh embodiment before actuation of the switch. FIG. 17 is a cross-sectional view showing the principal section of the poly-dome switch according to the seventh embodiment at the time of actuation of the switch. Those elements which are essentially the same as the constituent elements set forth are assigned the same reference numerals, and their explanations are omitted.

Referring to FIG. 15, in the seventh embodiment, an air release structure used at the time of actuation of a switch is constituted by a poly-dome switch 141 (corresponding to a dome switch described in claims), and a plate 142 serving as a mount member to which the poly-dome 141 is to be attached.

The poly-dome switch 141 is constituted by the front sheet 122, a spacer sheet 143, the FPC 124, and the adhesive sheet 125. The poly-dome switch 141 is fixed to the plate 142 through the adhesive sheet 125.

The spacer sheet 143 is provided with an upper-layer spacer sheet 144 and lower-layer spacer sheets 145, 145. The spacer sheet 142 has a three-layer structure. The pacer sheet 143 has the function as a member for preventing occurrence of deformation of the front sheet 122, as in the case of the spacer sheet 123 (see FIG. 11).

The upper-layer spacer sheet 144 is made of a sheet member of synthetic resin; e.g., polyethylene terephthalate (PET). The upper-layer spacer sheet 144 is formed thinner than the lower-layer spacer sheets 145, 145. The upper-layer spacer sheet 144 acts as a sheet member for effecting fine adjustment the thickness of the spacer sheet 143. The upper-layer spacer sheet 144 corresponds to the uppermost spacer sheet described in claims.

Since an unillustrated adhesive layer is provided on either surface of the upper-layer spacer sheet 144, the front sheet 122 can be bonded to the front surface of the upper-layer spacer sheet 144, and the lower-layer spacer sheet 145 can be bonded to the back of the upper-layer space sheet 144. The upper-layer spacer sheet 144 includes a plurality of through holes 146.

Since an unillustrated adhesive layer is provided on either surface of the lower-layer spacer sheets 145 and 145, the upper-layer spacer sheet 144 can be bonded to the front surface of the lower-layer spacer sheet 145, and the FPC 124 can be bonded to the back of the lower-layer space sheet 145. Each of the lower-layer spacer sheets 145 includes a plurality of through holes 129, number of which corresponds to that of the through holes of the upper-layer spacer sheet 144, and a plurality of air release sections 130 (the through holes 129 formed in the lower-layer spacer sheet 145 are equal or larger in diameter than those formed in the upper-layer spacer sheet 143; the greater the diameter of the through hole 129, the larger an area can be ensured for air release purposes, therefore the tactile click is not impaired).

When the upper-layer spacer sheet 144 and the lower-layer spacer sheets 145 are overlaid one on top of the other, to thereby constitute the spacer sheet 143, the through holes 129 and the air release sections 130 formed in the upper-layer spacer sheet 144 are matched to those formed in the lower-layer spacer sheet 145.

The plate 142 has a mount surface 147 with which the adhesive attachment surface of the adhesive sheet 125 is to come into intimate contact. Space sections 148, 148, each having; e.g., a recessed cross-sectional profile, are formed in the mount surface 147. The space sections 148, 148 are formed and arranged so as to be aligned with the air release holes 134, 134 of the adhesive sheet 125 after assembly. The housing 126 or 126' may be used in place of the plate 142.

The poly-dome switch 141 having the foregoing construction will be described as follows. The upper-layer spacer sheet 144 and the lower-layer spacer sheets 145, 145 are bonded together, thereby forming the spacer sheet 143. Next, the front sheet 122 is bonded to the front surface of the spacer sheet 143 (in reality, the upper-layer spacer sheet 144). The FPC 124 is bonded to the back of the spacer sheet 143 (in reality, the lowermost-layer spacer sheet 145). Subsequently, the thus-produced assembly is bonded to the surface of the adhesive sheet 125 facing the FPC 124. Thus, assembly of the poly-dome switch 141 is completed. The adhesive attachment surface of the adhesive sheet 25 is closely attached to the mount surface 147 of the plate 142.

The operation of the poly-dome switch 141 is now described by reference to FIGS. 16 and 17. FIG. 16 is a cross-sectional view showing the principal section of the poly-dome switch according to the seventh embodiment before actuation of the switch. FIG. 17 is a cross-sectional view showing the principal section of the poly-dome switch according to the seventh embodiment at the time of actuation of the switch.

Referring to FIG. 16, when no load is imposed on the protuberance 127; that is, before actuation of the poly-dome switch 141, the geometry of the protuberance 127 is maintained by virtue of the shape-retaining characteristic thereof.

Referring to FIG. 17, when the protuberance 127 is depressed in the direction of the arrow as a result of actuation of the switch (i.e., load is imposed in the direction of the arrow), the protuberance 127 opposes the load and buckles to become reverse upon receipt of a certain load (at this time, the user feels a tactile click). The load imposed in the direction of the arrow diminishes as a result of buckling and reverse of the protuberance 127, so that the protuberance 127 is depressed smoothly. The thus-reversed protuberance 127 passes through the through hole 146 formed in the spacer sheet 143, and the electrode 128 attached to the protuberance 127 is brought into contact with the contact point 132 (see FIG. 15) of the FPC 124 through the through hole 129, there by bringing the circuit 131 (see FIG. 15) into conduction. Thus, the poly-dome switch 151 is turned on. When the load imposed in the direction of the arrow is released, the protuberance 127 returns to its original state.

When the protuberance 127 is reversed toward the FPC 124 as a result of actuation of the switch, the air having remained within the protuberance 127 escapes to the space sections 148, 148 from the air release sections 130, 130 of the lower-layer spacer sheets 145, 145 via the through holes 129, 129 of the lower-layer spacer sheets 145, 145.

As mentioned above, in the third embodiment, the space sections 148, 148 of the plate 142 can be utilized as space for air release purpose at the time of reversal of the protuberance 127. As in the case of the fifth and sixth embodiments, the air release space is broadened, thus increasing the volume of the air release space. As a result, a tactile click can be improved.

Figure 18:
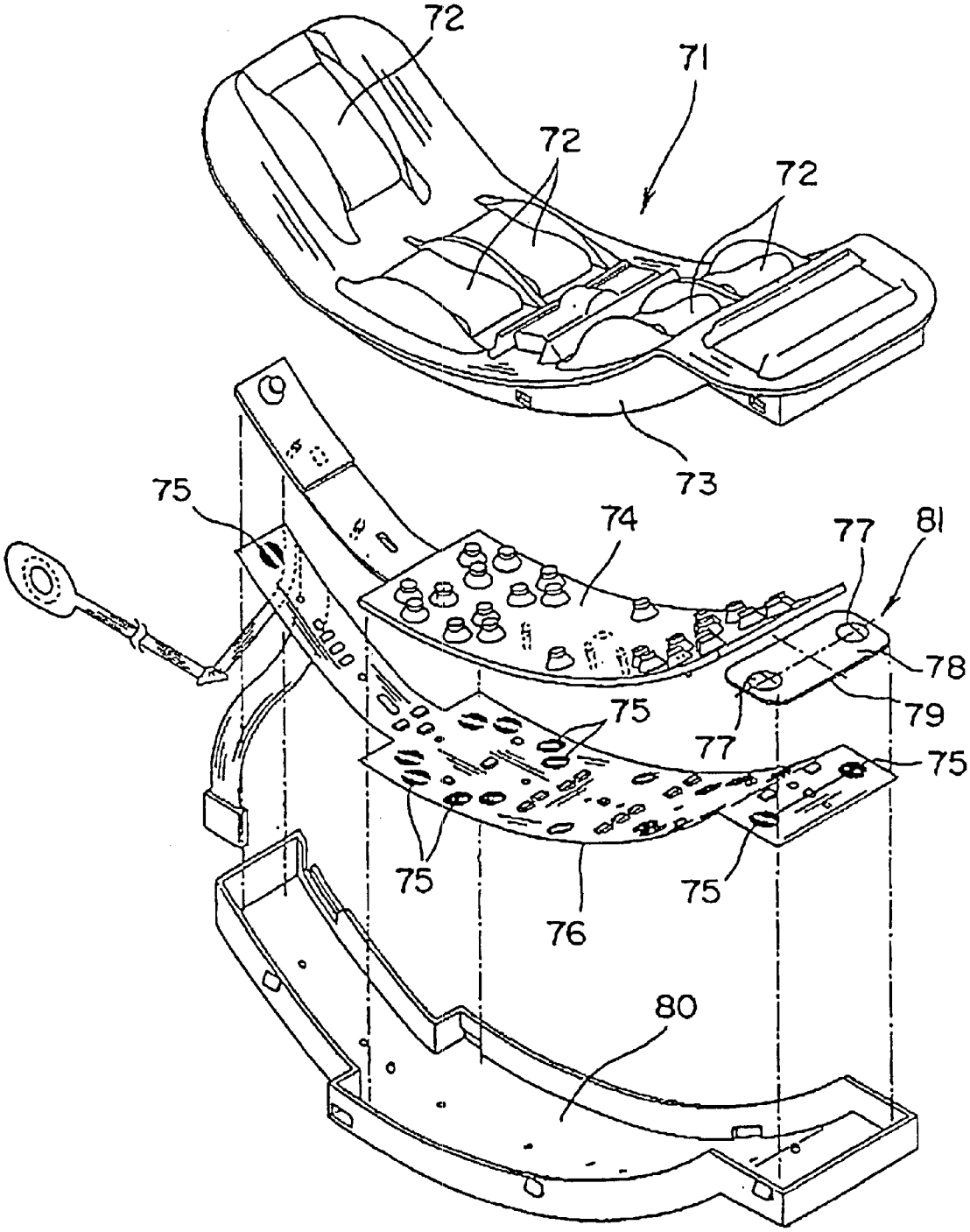
FIG. 18 is an exploded perspective view showing a specific example of attachment of the dome switch.
Figure 19:
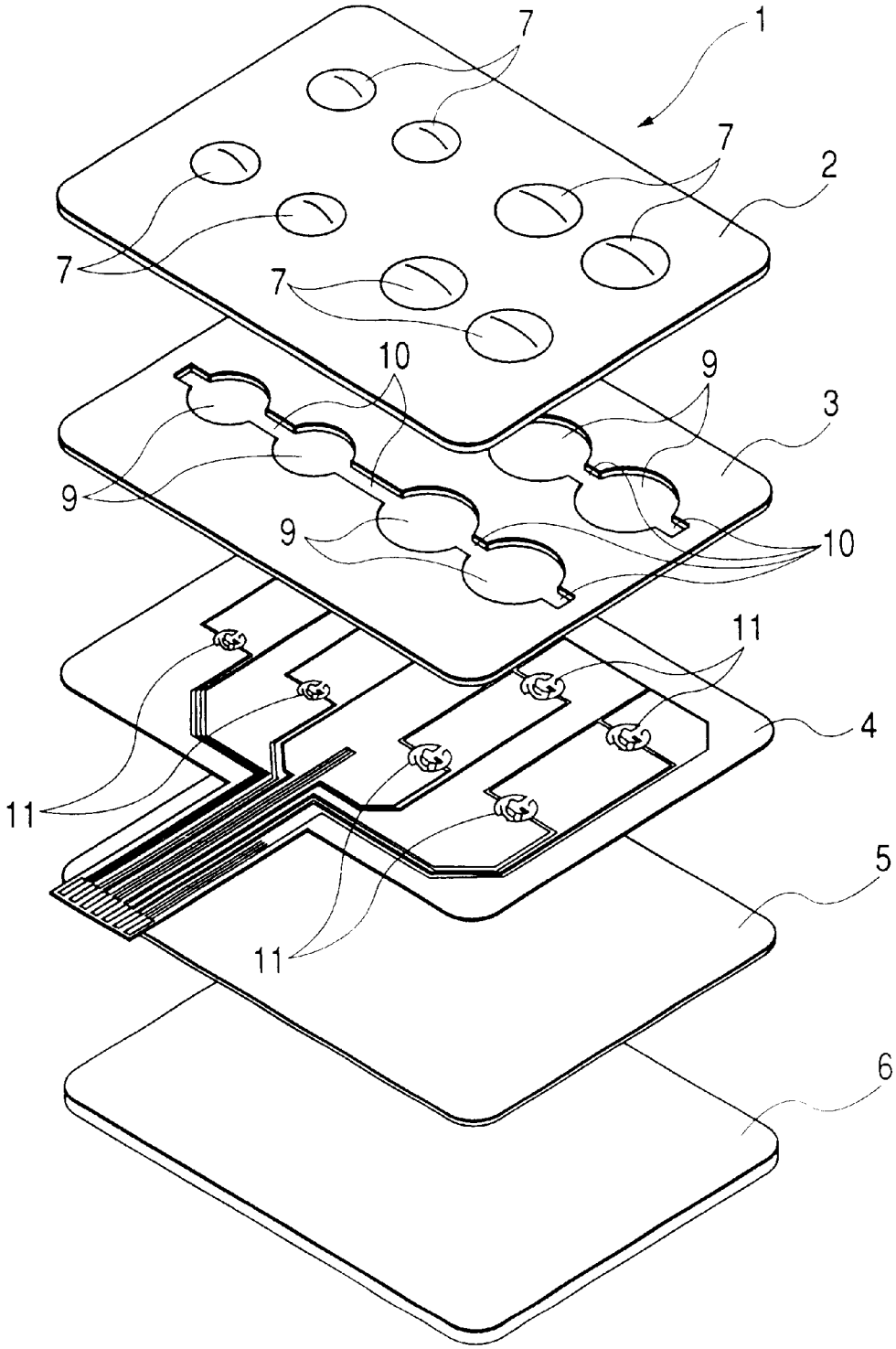
FIG. 19 PRIOR ART
FIG. 19 is an exploded perspective view showing a related-art poly-dome switch (dome switch)
Figure 20:
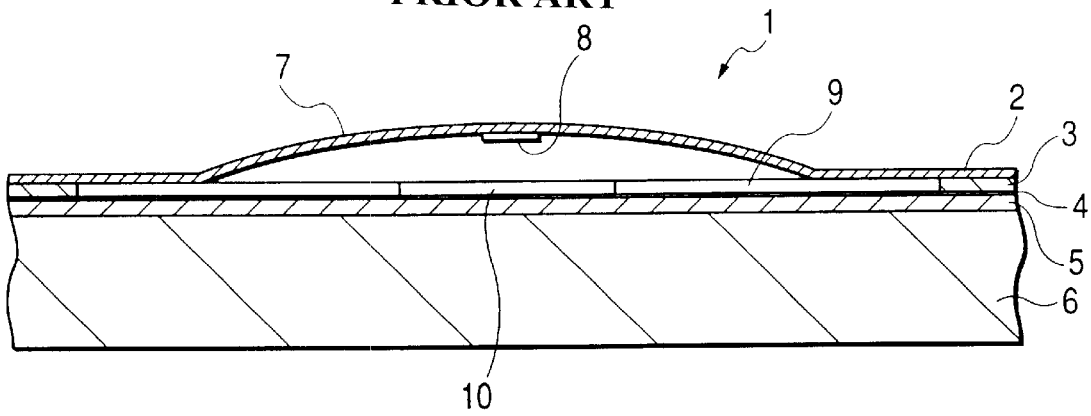
FIG. 20 PRIOR ART
FIG. 20 a cross-sectional view showing the principal section of the related-art dome switch before the switch is actuated.
Figure 21:
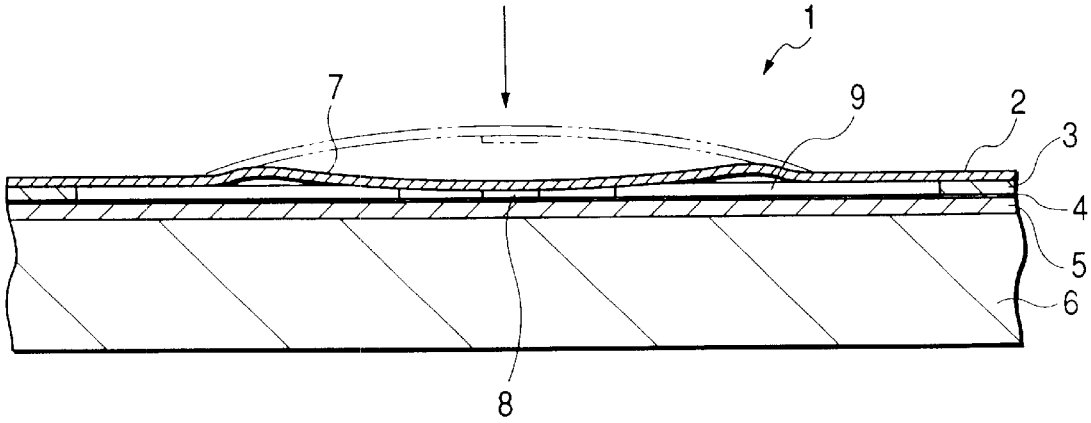
FIG. 21 PRIOR ART
FIG. 21 is a cross-sectional view showing the principal section of the related-art dome switch when the switch is actuated.

By reference to FIG. 18, a specific example of attachment of the dome switch 61 will now be described. FIG. 18 is an exploded perspective view showing the specific example of attachment of the dome switch 61.

In FIG. 18, reference numeral 71 designates a vehicle switch unit having a plurality of knob switches and poly-dome switches. The switch unit 71 comprises a bezel 73 having a plurality of switch knobs 72; a rubber contact 74; an FPC 76 serving as a circuit member having a plurality of contact points 75; a front sheet 78 having dome-shaped protuberances 77, 77; a spacer sheet 79 to be brought into intimate contact with the front sheet 78; and an under case 80 to be engaged with the bezel 73. The switch unit 71 is disposed in the vicinity of a door at the driver's seat or a center console. In the such a switch unit 71, a poly-dome switch 81 (corresponding to a dome switch described in claims) is constituted of the front sheet 78, the spacer sheet 79, and a portion of the FPC 76. The poly-dome switch 81 shares a portion of the switch unit 71. Needless to say, the entirety of the switch unit 71 may be constructed by a poly-dome switch such as the above-mentioned poly-dome switch 81.

Needless to say, the present invention is susceptible to various modifications without departing from the scope thereof. For instance, the spacer sheet may be constituted into a four-layer structure or a structure having more than four layers. Further, the number of protuberances is not limited to that mentioned above. The number of protuberances and lower-layer spacer sheets is not limited to that mentioned above. Further, the space section may be embodied not only as the dead space of the mount member of also as an actively-formed space.

The present invention is not for application to solely switches of equipment to be mounted on a vehicle, such as an automobile, or to a vehicle switch unit; the present invention can be applied to any type of switch, so long as the switch belongs to equipment which requires an increase in stroke dimension. Naturally, the present invention can be applied to switches used in household electrical appliances or switches of manufacturing apparatus.

As has been described, the invention described herein can effect maximum stroke of a protuberance. Hence, a dome switch according to the present invention yields an advantage of the ability to increase a stroke of the protuberance.

The invention described herein enables an increase in the stroke of the protuberance. Hence, there is yielded an advantage of facilitating adjustment of stroke dimension of the protuberance. Further, there is yielded an advantage of the ability to impart greater flexibility to a spacer sheet than is imparted to a spacer sheet of single layer (the same also applies to the embodiments shown in FIGS. 3 through 5).

The present invention described herein enables an increase in the stroke of the protuberance, thus yielding the ability to facilitate adjustment of stroke dimension of the protuberance. There is also yielded an advantage of the ability to finely adjust a stroke of the protuberance.

The present invention described herein enables an increase in the stroke of the protuberance, thus yielding the ability to facilitate adjustment of stroke dimension of the protuberance. There is also yielded an advantage of the ability to enable reverse of the protuberance without involvement of damage. Further, there is yielded an advantage of the ability to minimize deformation of the front sheet in the periphery of the through hole when the protuberance is reversed.

The present invention described herein enables an increase in the stroke of the protuberance, thus yielding the ability to facilitate adjustment of stroke dimension of the protuberance. Further, there is yielded an advantage of the ability to minimize deformation of the front sheet in the periphery of the through hole when the protuberance is reversed.

As has been described, the present invention enables utilization of space sections of a mount member as space for air release purposes at the time of reversal of a protuberance. Hence, there is yielded the advantage of the ability to improve a tactile click.

According to the present invention, unlike the through holes of the lower-layer spacer sheets, the through holes of the uppermost spacer sheet are not provided with the air release section. Hence, the through holes of the lower-layer spacer sheets can be made larger in diameter than those of the upper most spacer sheet, thus broadening the space for air release purposes. Accordingly, there is yielded the advantage of the ability to improve a tactile click. Further, there is also yielded the advantage of the ability to prevent occurrence of deformation or deformation arises in the periphery of the through hole.

According to the present invention, the space sections of the mount member can be utilized as space for air release purpose at the time of reversal of the protuberance 7. The air release space is broadened, thus increasing the volume of the air release space. As a result, a tactile click can be improved.

What is claimed is:

1. A dome switch including:

a front sheet;

a dome-shaped protuberance which is formed on the front sheet, so as to protrude outside, can be reversed inside and includes an electrode provided therein;

a circuit member having a contact point with which the electrode is brought into contact when the protuberance is reversed; and a spacer sheet for preventing occurrence of deformation of the front sheet, which is interposed between the front sheet and the circuit member, includes a through hole formed therein for ensuring contact between the electrode and the contact point and ensuring a stroke dimension of the protuberance, wherein the spacer sheet has a thickness which is approximately half the maximum stroke of the protuberance.

2. The dome switch according to claim 1, wherein the spacer sheet is constituted by a plurality of layers.

3. The dome switch according to claim 1, wherein the spacer sheet is constituted by an uppermost layer spacer sheet and at least one lower layer spacer sheet, and the uppermost layer spacer sheet facing the front sheet is used for finely adjusting the stroke dimension and is formed thinner than the at least one lower layer spacer sheet.

4. The dome switch according to claim 1, wherein a plurality of the protuberances are formed on the front sheet, and a plurality of the through holes corresponding to the plurality of the protuberances are formed on the spacer sheet.

5. The dome switch according to claim 4, wherein the plurality of the through holes communicate with each other through at least one air release section formed through the spacer sheet.

6. A dome switch including:

a front sheet;

a dome-shaped protuberance which is formed on the front sheet, so as to protrude outside, can be reversed inside and includes an electrode provided therein;

a circuit member having a contact point with which the electrode are brought into contact when the protuberance is reversed; and a spacer sheet for preventing occurrence of deformation of the front sheet, which is interposed between the front sheet and the circuit member, includes a through hole formed therein for ensuring contact between the electrode and the contact point and ensuring a stroke dimension of the protuberance, wherein a plurality of the protuberances are formed on the front sheet, and a plurality of the through holes corresponding to the plurality of the protuberances are formed on the spacer sheet;

wherein the plurality of the through holes are communicated each other through at least one air release section formed through the spacer sheet, and wherein the spacer sheet is constituted by an uppermost layer spacer sheet and at least one lower layer spacer sheet, the at least one air release section is formed in the at least one lower layer spacer sheet other than the uppermost layer spacer sheet facing the front sheet.

7. A dome switch including:

a front sheet;

a dome-shaped protuberance which is formed on the front sheet, so as to protrude outside, can be reversed inside and includes an electrode provided therein;

a circuit member having a contact point with which the electrode are brought into contact when the protuberance is reversed; and a spacer sheet for preventing occurrence of deformation of the front sheet, which is interposed between the front sheet and the circuit member, includes a through hole formed therein for ensuring contact between the electrode and the contact point and ensuring a stroke dimension of the protuberance, wherein the spacer sheet is constituted by an uppermost layer spacer sheet and at least one lower layer spacer sheet, and the through hole formed in the uppermost layer spacer sheet facing the front sheet is formed so as to be greater in diameter than the protuberance, and the through hole formed in the at least one lower layer spacer sheet is formed so as to be greater in diameter than the through hole formed through the uppermost spacer sheet.

8. A dome switch comprising:

a front sheet;

a dome-shaped protuberance which is formed on the front sheet so as to protrude outside, can be reversed inside, and includes an electrode provided therein;

a circuit member having a contact point with which the electrode is brought into contact when the protuberance is reversed;

a spacer sheet which is interposed between the front sheet and the circuit member and includes a through hole formed therein for ensuring contact between the electrode and the contact point;

an adhesive sheet including at one side thereof a circuit member attachment surface to be adhered to the circuit member and at the other side an adhesive fixing surface to be attached to a mount member including a space section formed in a mount surface thereof; and an air release hole, formed through the adhesive sheet, which communicates the space section with the through hole for air release at the time of reversal of the protuberance when the adhesive sheet adheres the circuit member to the mount member.

9. The dome switch according to claim 8, wherein a plurality of the protuberances are formed on the front sheet, and a plurality of the through holes corresponding to the plurality of the protuberances are formed on the spacer sheet.

10. The dome switch according to claim 9, wherein the plurality of the through holes communicate with each other through at least one air release section formed through the spacer sheet.

11. The dome switch according to claim 10, wherein the air release hole communicates with the at least one air release section.

12. A dome switch comprising:

a front sheet;

a plurality of dome-shaped protuberances which are formed on the front sheet so as to protrude outside, can be reversed inside, and each includes an electrode provided therein;

a circuit member having a plurality of contact points with, each of the contact points being brought into contact with the corresponding electrode when the corresponding protuberance is reversed;

a spacer sheet which is interposed between the front sheet and the circuit member and includes a plurality of through holes, respectively corresponding to the plurality of protuberances, formed therein for ensuring contact between the electrodes and the plurality of contact points, the spacer sheet including, an uppermost layer spacer sheet, and at least one lower layer spacer sheet interposed between the uppermost layer spacer sheet and the circuit member, wherein the plurality of through holes communicate with each other through at least one air release section formed through the at least one lower layer spacer sheet other than the uppermost layer space sheet; and an adhesive sheet including at one side thereof a circuit member attachment surface to be adhered to the circuit member and at the other side an adhesive fixing surface to be attached to a mount member.

13. The dome switch according to claim 12, wherein the adhesive sheet includes an air release hole which communicates a space section formed in a mount surface of the mount member with at least one of the through holes for air release at the time of reversal of one of the protuberances.

* * * * *